US008407951B2

(12) United States Patent
Haney et al.

(10) Patent No.: US 8,407,951 B2
(45) Date of Patent: Apr. 2, 2013

(54) MODULAR SYNTHETIC FLOOR TILE CONFIGURED FOR ENHANCED PERFORMANCE

(75) Inventors: Thayne Haney, Syracuse, UT (US); Mark Jenkins, Salt Lake City, UT (US); Cheryl Forster, Salt Lake City, UT (US); Jeremiah Shapiro, West Valley City, UT (US); Dana Hedquist, Bountiful, UT (US)

(73) Assignee: Connor Sport Court International, LLC, Salt Lake City, UT (US)

( * ) Notice: Subject to any disclaimer, the term of this patent is extended or adjusted under 35 U.S.C. 154(b) by 163 days.

(21) Appl. No.: 11/732,714

(22) Filed: Apr. 3, 2007

(65) Prior Publication Data

US 2007/0289244 A1 Dec. 20, 2007

Related U.S. Application Data

(63) Continuation-in-part of application No. 11/244,723, filed on Oct. 5, 2005.

(60) Provisional application No. 60/616,885, filed on Oct. 6, 2004, provisional application No. 60/834,588, filed on Jul. 31, 2006.

(51) Int. Cl.
*E04F 11/16* (2006.01)

(52) U.S. Cl. ..... 52/177; 52/180; 52/390; 52/591.1

(58) Field of Classification Search ..... 52/177, 52/180, 384–387, 390, 392, 591.1–591.3; 404/41, 47; 15/215
See application file for complete search history.

(56) References Cited

U.S. PATENT DOCUMENTS

| | | | |
|---|---|---|---|
| 321,403 | A | 6/1885 | Underwood |
| 658,868 | A | 10/1900 | Rosenbaum |
| 1,177,231 | A | 3/1916 | Carter |
| 1,425,324 | A | 8/1922 | Kennedy |
| 1,472,956 | A | 11/1923 | Biegler |
| 1,824,571 | A | 5/1927 | Richardson |
| 1,896,957 | A | 2/1933 | Hutcheson |
| 1,971,320 | A | 8/1934 | Cederquist |
| 2,082,563 | A | 6/1937 | Bauer |
| 2,225,828 | A | 12/1940 | Godschall |

(Continued)

FOREIGN PATENT DOCUMENTS

| | | |
|---|---|---|
| CN | 2221623 | 6/1996 |
| EP | 0044371 | 1/1982 |

(Continued)

OTHER PUBLICATIONS

Synthetic Floor Tile, pp. 1-7.

(Continued)

*Primary Examiner* — William Gilbert
*Assistant Examiner* — Chi Nguyen
(74) *Attorney, Agent, or Firm* — Thorpe North & Western LLP

(57) ABSTRACT

A modular synthetic floor tile comprising: (a) an upper contact surface; (b) a plurality of openings formed in the upper contact surface, each of the openings having a geometry defined by structural members configured to intersect with one another at various intersection points to form at least one acute angle as measured between imaginary axes extending through the intersection points, the structural members having a smooth, planar top surface forming the contact surface, and a face oriented transverse to the top surface; (c) a transition surface extending between the top surface and the face of the structural members configured to provide a blunt edge between the top surface and the face, and to reduce abrasiveness of the floor tile; and (d) means for coupling the floor tile to at least one other floor tile.

27 Claims, 21 Drawing Sheets

U.S. PATENT DOCUMENTS

| | | | | |
|---|---|---|---|---|
| 2,653,525 | A | | 9/1953 | Sargeant |
| 2,680,698 | A | | 6/1954 | Schnee |
| 2,735,166 | A | | 2/1956 | Hoseason |
| 2,810,672 | A | | 10/1957 | Taylor |
| 3,015,136 | A | | 1/1962 | Doe |
| 3,122,073 | A | | 2/1964 | Masse |
| 3,222,834 | A | | 12/1965 | Taft |
| 3,251,076 | A | | 5/1966 | Burke |
| 3,310,906 | A | | 3/1967 | Glukes |
| 3,318,476 | A | | 5/1967 | Clark |
| 3,332,192 | A | | 7/1967 | Kessler et al. |
| 3,350,013 | A | | 10/1967 | Bergquist |
| 3,425,624 | A | | 2/1969 | Jacobs |
| 3,438,312 | A | | 4/1969 | Becker et al. |
| 3,439,312 | A | | 4/1969 | Greasley |
| 3,500,606 | A | | 3/1970 | Wharmby |
| 3,511,001 | A | | 5/1970 | Morgan |
| 3,531,902 | A | | 10/1970 | Costa |
| 3,565,276 | A | | 2/1971 | O'Brien |
| 3,611,609 | A | | 10/1971 | Neljnhard |
| 3,614,915 | A | | 10/1971 | Perry |
| 3,717,247 | A | | 2/1973 | Moore |
| 3,723,233 | A | | 3/1973 | Bourke |
| 3,735,988 | A | | 5/1973 | Palmer et al. |
| 3,736,713 | A | | 6/1973 | Flachbarth et al. |
| 3,775,918 | A | | 12/1973 | Johnson |
| 3,795,180 | A | | 3/1974 | Larsen |
| 3,802,144 | A | | 4/1974 | Spica |
| 3,820,912 | A | | 6/1974 | Hughes |
| 3,823,521 | A | | 7/1974 | Heitholt et al. |
| 3,836,075 | A | | 9/1974 | Botbol |
| 3,844,440 | A | | 10/1974 | Hadfield et al. |
| 3,909,996 | A | | 10/1975 | Ettlinger, Jr. et al. |
| 3,911,635 | A | | 10/1975 | Traupe |
| 3,922,409 | A | | 11/1975 | Stark |
| 3,925,946 | A | | 12/1975 | Balinski et al. |
| 3,937,861 | A | | 2/1976 | Zuckerman et al. |
| 3,946,529 | A | | 3/1976 | Chevaux |
| 3,955,836 | A | | 5/1976 | Traupe |
| 4,008,352 | A | | 2/1977 | Dawes et al. |
| 4,008,548 | A | | 2/1977 | Leclerc |
| 4,018,025 | A | | 4/1977 | Collette |
| 4,054,987 | A | | 10/1977 | Forlenza |
| 4,118,892 | A | | 10/1978 | Nakamura et al. |
| 4,133,481 | A | | 1/1979 | Bennett |
| 4,167,599 | A | * | 9/1979 | Nissinen ..... 428/44 |
| D255,744 | S | | 7/1980 | Dekko |
| 4,226,060 | A | | 10/1980 | Sato |
| 4,226,064 | A | | 10/1980 | Kraayenhof |
| 4,244,484 | A | | 1/1981 | Guritz et al. |
| 4,274,626 | A | | 6/1981 | Grosser et al. |
| 4,285,518 | A | | 8/1981 | Pearo |
| 4,287,693 | A | | 9/1981 | Collete |
| 4,338,758 | A | | 7/1982 | Hagbjer |
| 4,361,614 | A | | 11/1982 | Moffitt, Jr. |
| 4,386,138 | A | | 5/1983 | Arbit |
| 4,419,382 | A | | 12/1983 | Sliemers et al. |
| 4,424,968 | A | | 1/1984 | Smith |
| 4,436,779 | A | | 3/1984 | Menconi et al. |
| 4,440,818 | A | | 4/1984 | Buchan et al. |
| D274,948 | S | | 7/1984 | Swanson et al. |
| 4,468,910 | A | | 9/1984 | Morrison |
| 4,478,901 | A | | 10/1984 | Dickens et al. |
| 4,478,905 | A | | 10/1984 | Neely, Jr. et al. |
| 4,497,858 | A | | 2/1985 | Dupont et al. |
| 4,509,930 | A | | 4/1985 | Schweigert et al. |
| 4,526,347 | A | | 7/1985 | McLoughlin |
| 4,541,132 | A | | 9/1985 | Long |
| 4,559,250 | A | | 12/1985 | Paige |
| 4,577,448 | A | | 3/1986 | Howorth |
| 4,584,221 | A | | 4/1986 | Kung |
| 4,590,731 | A | | 5/1986 | DeGooyer |
| 4,596,729 | A | | 6/1986 | Morrison |
| 4,596,731 | A | | 6/1986 | Cudmore et al. |
| D286,575 | S | | 11/1986 | Saunders |
| 4,640,075 | A | | 2/1987 | Nuncio |
| 4,648,592 | A | | 3/1987 | Harinishi |
| 4,650,180 | A | | 3/1987 | Blondel |
| 4,650,188 | A | | 3/1987 | Schroeder |
| 4,681,482 | A | | 7/1987 | Arciszewski et al. |
| 4,681,786 | A | | 7/1987 | Brown |
| 4,694,627 | A | | 9/1987 | Omholt |
| 4,702,048 | A | | 10/1987 | Millman |
| 4,715,743 | A | | 12/1987 | Schmanski |
| 4,727,697 | A | | 3/1988 | Vaux |
| 4,728,468 | A | | 3/1988 | Duke |
| 4,749,302 | A | | 6/1988 | DeClute |
| 4,766,020 | A | | 8/1988 | Ellingson, Jr. |
| 4,807,412 | A | | 2/1989 | Frederiksen |
| 4,819,932 | A | | 4/1989 | Trotter |
| 4,826,351 | A | | 5/1989 | Haberhauer et al. |
| 4,849,267 | A | | 7/1989 | Ward et al. |
| 4,860,510 | A | | 8/1989 | Kotler |
| 4,875,800 | A | | 10/1989 | Hicks |
| 4,877,672 | A | | 10/1989 | Shreiner |
| 4,917,532 | A | | 4/1990 | Haberhauer et al. |
| 4,930,286 | A | | 6/1990 | Kotler |
| 4,948,116 | A | | 8/1990 | Vaux |
| 4,963,054 | A | | 10/1990 | Hayashi |
| 4,964,751 | A | | 10/1990 | Rope et al. |
| 4,973,505 | A | | 11/1990 | Bielous |
| 5,022,200 | A | | 6/1991 | Wilson et al. |
| 5,039,365 | A | | 8/1991 | Rutledge et al. |
| 5,048,448 | A | | 9/1991 | Yoder |
| 5,052,158 | A | | 10/1991 | D'Luzansky |
| 5,111,630 | A | | 5/1992 | Munsey et al. |
| D327,748 | S | | 7/1992 | Dorfman, Jr. |
| 5,143,757 | A | | 9/1992 | Skinner |
| 5,157,804 | A | | 10/1992 | Williams |
| 5,160,215 | A | | 11/1992 | Jensen |
| 5,185,193 | A | | 2/1993 | Phenicie et al. |
| 5,190,799 | A | | 3/1993 | Ellingson |
| 5,195,288 | A | | 3/1993 | Penczak |
| 5,205,091 | A | | 4/1993 | Brown |
| 5,205,092 | A | | 4/1993 | Taylor |
| 5,215,802 | A | | 6/1993 | Sijpesteijn |
| 5,228,253 | A | | 7/1993 | Wattelez |
| 5,229,437 | A | | 7/1993 | Knight |
| 5,234,738 | A | | 8/1993 | Wolf |
| 5,250,340 | A | | 10/1993 | Bohnhoff |
| 5,253,464 | A | | 10/1993 | Nilsen |
| 5,295,341 | A | | 3/1994 | Kajiwara |
| 5,303,669 | A | | 4/1994 | Szekely |
| 5,323,575 | A | | 6/1994 | Yeh |
| 5,333,423 | A | | 8/1994 | Propst |
| 5,342,141 | A | | 8/1994 | Close |
| 5,364,204 | A | | 11/1994 | MacLeod |
| 5,365,710 | A | | 11/1994 | Randjelovic |
| 5,379,557 | A | | 1/1995 | Kotter |
| 5,387,842 | A | | 2/1995 | Roth et al. |
| 5,403,453 | A | | 4/1995 | Roth et al. |
| 5,403,637 | A | | 4/1995 | Pickard et al. |
| 5,412,917 | A | | 5/1995 | Shelton |
| 5,414,324 | A | | 5/1995 | Roth et al. |
| 5,418,036 | A | | 5/1995 | Tokikawa et al. |
| 5,449,246 | A | | 9/1995 | Housley |
| 5,456,972 | A | | 10/1995 | Roth et al. |
| 5,462,771 | A | | 10/1995 | Motoki et al. |
| 5,466,424 | A | | 11/1995 | Kusano et al. |
| 5,466,489 | A | | 11/1995 | Stahl |
| 5,502,148 | A | | 3/1996 | Hentschel et al. |
| 5,509,244 | A | | 4/1996 | Bentzon |
| 5,511,353 | A | | 4/1996 | Jones |
| 5,518,799 | A | | 5/1996 | Finestone et al. |
| 5,526,619 | A | | 6/1996 | Vagedes |
| 5,527,128 | A | | 6/1996 | Rope et al. |
| 5,542,221 | A | | 8/1996 | Streit et al. |
| 5,567,490 | A | | 10/1996 | Papazian et al. |
| 5,573,715 | A | | 11/1996 | Adams et al. |
| D377,398 | S | | 1/1997 | Adam |
| 5,616,389 | A | | 4/1997 | Blatz |
| 5,628,160 | A | * | 5/1997 | Kung ..... 52/591.1 |
| 5,634,309 | A | | 6/1997 | Polen |
| 5,640,821 | A | | 6/1997 | Koch |
| 5,642,592 | A | | 7/1997 | Andres |
| 5,647,184 | A | | 7/1997 | Davis |
| 5,679,385 | A | | 10/1997 | Adams et al. |

5,682,724 A 11/1997 Randjelovic
5,693,390 A 12/1997 Inagaki et al.
5,693,395 A 12/1997 Wine
5,695,064 A 12/1997 Huang et al.
5,713,175 A 2/1998 Mitchell
5,713,806 A 2/1998 Teitgen et al.
5,735,096 A 4/1998 Krass
5,749,787 A 5/1998 Jank
5,758,467 A 6/1998 Snear et al.
5,761,867 A 6/1998 Carling
5,787,654 A 8/1998 Drost
5,803,973 A 9/1998 Szczyrbowski et al.
5,815,995 A 10/1998 Adam
5,816,010 A 10/1998 Conn
5,816,738 A 10/1998 Harnapp
5,819,491 A 10/1998 Davis
5,820,294 A 10/1998 Baranowski
5,822,828 A 10/1998 Berard et al.
5,833,386 A 11/1998 Rosan et al.
5,848,856 A 12/1998 Bohnhoff
5,865,007 A 2/1999 Bowman et al.
5,899,038 A 5/1999 Stroppiana
5,904,021 A 5/1999 Fisher
5,906,082 A 5/1999 Counihan
5,906,454 A 5/1999 Medico et al.
5,907,934 A 6/1999 Austin
5,910,401 A 6/1999 Anderson et al.
5,937,602 A 8/1999 Jalbert
5,950,378 A 9/1999 Council et al.
D415,581 S 10/1999 Bertolini
5,992,106 A 11/1999 Carling et al.
6,017,577 A 1/2000 Hostettler et al.
6,032,428 A 3/2000 Rosan et al.
6,044,598 A 4/2000 Elsasser et al.
6,047,663 A 4/2000 Moreau et al.
6,068,908 A 5/2000 Kessler et al.
6,095,718 A 8/2000 Bohnhoff
6,098,354 A * 8/2000 Skandis ..... 52/177
6,101,788 A 8/2000 Weder et al.
6,112,479 A 9/2000 Andres
6,128,881 A 10/2000 Bue et al.
6,134,854 A 10/2000 Stanchfield
D435,122 S 12/2000 Ross et al.
6,171,015 B1 1/2001 Barth et al.
D437,427 S 2/2001 Shaffer
6,189,289 B1 2/2001 Quaglia et al.
6,228,433 B1 5/2001 Witt
6,230,460 B1 5/2001 Huyett
6,231,939 B1 5/2001 Shaw et al.
6,286,272 B1 9/2001 Sandoz
6,301,842 B1 10/2001 Chaney et al.
6,302,803 B1 10/2001 Barlow
6,321,499 B1 11/2001 Chuang
6,324,796 B1 12/2001 Heath
6,345,483 B1 2/2002 Clark
6,355,323 B1 3/2002 Iwen et al.
D456,533 S 4/2002 Moller, Jr.
6,397,543 B1 6/2002 Hamar
6,418,683 B1 7/2002 Martensson et al.
6,428,870 B1 8/2002 Bohnhoff
6,436,159 B1 8/2002 Safta et al.
6,451,400 B1 * 9/2002 Brock et al. ..... 428/44
6,453,632 B1 9/2002 Huang
6,467,224 B1 10/2002 Bertolini
6,526,705 B1 3/2003 MacDonald
6,531,203 B2 3/2003 Kessler et al.
6,543,196 B1 4/2003 Gonzales
6,562,414 B2 5/2003 Carling
6,578,324 B2 6/2003 Kessler et al.
6,585,449 B2 7/2003 Chen
6,588,166 B2 7/2003 Martensson et al.
6,605,333 B2 8/2003 Ferreira et al.
6,606,834 B2 8/2003 Martensson et al.
6,617,009 B1 9/2003 Chen et al.
D481,138 S 10/2003 Forster et al.
D481,470 S 10/2003 Moller, Jr.
6,637,163 B2 10/2003 Thibault et al.
6,669,572 B1 12/2003 Barlow
6,672,970 B2 1/2004 Barlow
6,672,971 B2 1/2004 Barlow
6,682,254 B1 1/2004 Olofsson et al.
D486,592 S 2/2004 Hong
6,684,582 B2 2/2004 Peart et al.
6,684,592 B2 2/2004 Martin
6,695,527 B2 2/2004 Seaux et al.
6,718,714 B1 4/2004 Montgomery
6,718,715 B2 4/2004 Elliott
6,736,569 B2 5/2004 Lee
6,739,797 B1 5/2004 Schneider
D492,426 S 6/2004 Strickler
6,751,912 B2 6/2004 Stegner et al.
6,769,219 B2 8/2004 Schwitte et al.
6,793,586 B2 9/2004 Barlow et al.
6,802,159 B1 10/2004 Kotler
6,820,386 B2 11/2004 Kappeli et al.
6,833,038 B2 12/2004 Iwen et al.
6,851,236 B1 2/2005 Harvey
6,878,430 B2 4/2005 Milewski et al.
6,880,307 B2 4/2005 Schwitte et al.
6,895,881 B1 5/2005 Whitaker
6,931,808 B2 8/2005 Hamar
6,962,463 B2 11/2005 Chen
7,021,012 B2 4/2006 Zeng et al.
7,029,744 B2 4/2006 Horstman et al.
D522,149 S 5/2006 Shin
7,047,697 B1 5/2006 Heath
7,065,935 B2 6/2006 Ralf
7,090,430 B1 8/2006 Fletcher et al.
7,096,632 B2 8/2006 Pacione
7,114,298 B2 10/2006 Kotler
7,127,857 B2 10/2006 Randjelovic
D532,530 S 11/2006 Shuman et al.
7,131,788 B2 11/2006 Ianniello et al.
7,144,609 B2 12/2006 Reddick
7,155,796 B2 1/2007 Cook
7,211,314 B2 5/2007 Nevison
7,299,592 B2 11/2007 Moller, Jr.
7,303,800 B2 12/2007 Rogers
7,340,865 B2 3/2008 Vanderhoef
7,383,663 B2 6/2008 Pacione
7,386,963 B2 6/2008 Pervan
7,412,806 B2 8/2008 Pacione et al.
7,464,510 B2 12/2008 Scott et al.
7,516,587 B2 4/2009 Barlow
7,520,948 B2 4/2009 Tavy et al.
D593,220 S 5/2009 Reed
7,527,451 B2 5/2009 Slater
7,531,055 B2 5/2009 Mead
7,563,052 B2 7/2009 Van Reijen
7,571,572 B2 8/2009 Moller, Jr.
7,571,573 B2 * 8/2009 Moller, Jr. ..... 52/177
7,587,865 B2 9/2009 Moller, Jr.
RE41,140 E 2/2010 Heath
D611,626 S 3/2010 Ardern
7,676,291 B2 3/2010 Sheffield et al.
7,704,011 B2 4/2010 Marshall
7,748,176 B2 7/2010 Harding et al.
7,748,177 B2 7/2010 Jenkins et al.
7,900,416 B1 3/2011 Yokubison et al.
7,950,191 B2 5/2011 Brouwers
2001/0002523 A1 6/2001 Chen
2002/0071927 A1 6/2002 Kessler et al.
2002/0152702 A1 10/2002 Tseng
2002/0189176 A1 12/2002 Stegner et al.
2003/0009971 A1 1/2003 Palmberg
2003/0093964 A1 5/2003 Bushey et al.
2003/0148813 A1 8/2003 Barlow
2003/0190969 A1 10/2003 Barlow et al.
2004/0023006 A1 2/2004 Mead
2004/0035079 A1 2/2004 Evjen
2004/0182030 A1 9/2004 Hinault et al.
2004/0235580 A1 11/2004 Barlow et al.
2004/0258869 A1 12/2004 Walker
2005/0016098 A1 1/2005 Hahn
2005/0028475 A1 2/2005 Barlow et al.
2005/0144867 A1 7/2005 Clarke
2005/0193670 A1 9/2005 Niese et al.
2005/0202208 A1 9/2005 Kelly

| | | | |
|---|---|---|---|
| 2005/0204676 | A1 | 9/2005 | Weitzer |
| 2005/0252109 | A1 | 11/2005 | Fuccella et al. |
| 2006/0070314 | A1 | 4/2006 | Jenkins |
| 2006/0080909 | A1 | 4/2006 | Harding et al. |
| 2006/0265975 | A1 | 11/2006 | Geffe |
| 2006/0272252 | A1 | 12/2006 | Moller, Jr. |
| 2006/0285920 | A1 | 12/2006 | Gettig et al. |
| 2007/0214741 | A1 | 9/2007 | Llorens Miravet |
| 2007/0289244 | A1 | 12/2007 | Haney et al. |
| 2008/0092473 | A1 | 4/2008 | Heyns |
| 2008/0127593 | A1 | 6/2008 | Janesky |
| 2008/0168736 | A1 | 7/2008 | Pervan |
| 2008/0172968 | A1 | 7/2008 | Pacione |
| 2008/0216437 | A1 | 9/2008 | Prevost et al. |
| 2008/0271410 | A1 | 11/2008 | Matthee |
| 2008/0295437 | A1 | 12/2008 | Dagger |
| 2009/0031658 | A1 | 2/2009 | Moller, Jr. et al. |
| 2009/0049768 | A1 | 2/2009 | Kim |
| 2009/0139160 | A1 | 6/2009 | Hill |
| 2009/0235605 | A1 | 9/2009 | Haney |
| 2010/0236176 | A1 | 9/2010 | Jenkins |
| 2011/0045916 | A1 | 2/2011 | Casimaty et al. |

FOREIGN PATENT DOCUMENTS

| | | | |
|---|---|---|---|
| EP | 1167652 | | 1/2002 |
| FR | 2240320 | | 3/1975 |
| GB | 1504811 | | 3/1978 |
| GB | 2262437 | | 6/1993 |
| GB | 2263644 | A | 8/1993 |
| GB | 2 353 543 | | 2/2001 |
| JP | 01-226978 | | 9/1989 |
| KR | 10-2006-0127635 | | 12/2006 |
| KR | 20-0239521 | | 10/2011 |
| WO | WO9201130 | | 1/1992 |

OTHER PUBLICATIONS

Synthetic Floor Tile, pp. 8-12.
Synthetic Floor Tile, pp. 13-17.
Synthetic Floor Tile, pp. 18-21.
Synthetic Floor Tile, p. 22.
Synthetic Floor Tile, pp. 23-27.
Synthetic Floor Tile, pp. 28-32.
Synthetic Floor Tile, pp. 33-37.
Synthetic Floor Tile, pp. 38-42.
Synthetic Floor Tile, pp. 43-47.
Synthetic Floor Tile, pp. 48-52.
Synthetic Floor Tile, pp. 53-57.
Synthetic Floor Tile, pp. 58-62.
Synthetic Floor Tile, pp. 63-67.
Synthetic Floor Tile, pp. 68-72.
Synthetic Floor Tile, pp. 73-77.
Synthetic Floor Tile, pp. 78-82.
Synthetic Floor Tile, pp. 83-87.
Synthetic Floor Tile, pp. 88-92.
Synthetic Floor Tile, pp. 93-97.
Synthetic Floor Tile, pp. 98-102.
Synthetic Floor Tile, pp. 103-107.
Synthetic Floor Tile, pp. 108-112.
Synthetic Floor Tile, pp. 113-117.
Synthetic Floor Tile, pp. 118-122.
Synthetic Floor Tile, pp. 123-127.
Synthetic Floor Tile, pp. 128-133.
Synthetic Floor Tile, pp. 134-138.
Synthetic Floor Tile, pp. 139-143.
Synthetic Floor Tile, pp. 144-148.
Synthetic Floor Tile, pp. 149-153.
Synthetic Floor Tile, pp. 154-159.
Synthetic Floor Tile, pp. 160-164.
Synthetic Floor Tile, pp. 165-169.
Synthetic Floor Tile, pp. 170-174.
Synthetic Floor Tile, pp. 175-179.
Synthetic Floor Tile, pp. 180-184.
Synthetic Floor Tile, pp. 185-189.
Synthetic Floor Tile, pp. 190-194.
Synthetic Floor Tile, pp. 195-199.
Synthetic Floor Tile, pp. 200-204.
Synthetic Floor Tile, pp. 205-209.
Synthetic Floor Tile, pp. 210-214.
Synthetic Floor Tile, pp. 215-219.
Synthetic Floor Tile, pp. 220-224.
Synthetic Floor Tile, pp. 225-229.
Synthetic Floor Tile, pp. 230-234.
Synthetic Floor Tile, pp. 235-239.
Synthetic Floor Tile, pp. 240-244.
Synthetic Floor Tile, pp. 245-249.
Synthetic Floor Tile, pp. 250-254.
PCT Application PCT/US2011/022802; filed Jan. 28, 2011; Ronald N. Cerny; International Search Report mailed Sep. 28, 2011.
Synthetic Tile Floor; 88 pages.
www.invisiblestructures.com webiste Jul. 26, 2006, 109 pages.
www.mateflex.stores.yahoo.net websiter Jul. 26, 2006, 68 pages.
www.namintec.com, website, Jul. 26, 2006, 28 pages.
www.polypavement.com/costs.htm, website Mar. 24, 2006, pp. 1-2.
www.polypavement.com/more_info.htm, website Mar. 24, 2006 pp. 1-12.
www.polypavement.com/index.htm, website Mar. 24, 2006, pp. 1-6.
Inter Partes Reexamination for Patent No. 7,748,177; Request filed Dec. 29, 2011; 192 pages.
U.S. Appl. No. 95/000,651; filed Dec. 29, 2011; office action issued Feb. 3, 2012.
Affidavit of Christopher Butler; signed Jan. 24, 2011; received by Thorpe North and Western on Jul. 8, 2011; 13 pages.
"Standard Test Method for Relative Abrasiveness of Synthetic Turf Playing Surfaces"; Copyright ASTM International; Jul. 10, 2003.
"Standard Test Method for Abrasion Resistance of Textile Fabrics (Rotary Platform, Double-Head Method)" ; Copy right by ASTM; Jan. 15, 2009.

* cited by examiner

MODULAR SYNTHETIC FLOOR TILE CONFIGURED FOR ENHANCED PERFORMANCE

RELATED APPLICATIONS

The present application is a continuation in-part application, which claims the benefit of U.S. patent application Ser. No. 11/244,723, filed Oct. 5, 2005, which claims the benefit of U.S. Provisional Application No. 60/616,885, filed Oct. 6, 2004. The present application also claims the benefit of U.S. Provisional Application No. 60/834,588, filed Jul. 31, 2006. Each of the above-referenced applications are incorporated by reference in their entirety herein.

FIELD OF THE INVENTION

The present invention relates generally to synthetic floor tiles, and more particularly to a modular synthetic floor tile in which its elements are designed and configured to enhance the performance characteristics of the floor tile through optimization of various design factors.

BACKGROUND OF THE INVENTION AND RELATED ART

Numerous types of flooring have been used to create multi-use surfaces for sports, activities, and for various other purposes. In recent years, the technology in modular flooring assemblies or systems made of a plurality of modular floor tiles has become quite advanced and, as a result, the use of such systems has grown significantly in popularity, particularly in terms of residential and mobile game court use.

Modular synthetic flooring systems generally comprise a series of individual interlocking or removably coupling floor tiles that can either be permanently installed over a support base or subfloor, such as concrete or wood, or temporarily installed over a similar support base or subfloor from time to time when needed, such as in the case of a mobile game court installed and then removed in different locations for a particular event. Another These floors and floor systems can be used both indoors or outdoors.

Modular synthetic flooring systems utilizing modular synthetic floor tiles provide several advantages over more traditional flooring materials and constructions. One particular advantage is that they are generally inexpensive and lightweight, thus making installation and removal less burdensome. Another advantage is that they are easily replaced and maintained. Indeed, if one tile becomes damaged, it can be removed and replaced quickly and easily. In addition, if the flooring system needs to be temporarily removed, the individual floor tiles making up the flooring system can easily be detached, packaged, stored, and transported (if necessary) for subsequent use.

Another advantage lies in the types materials that are used to construct the individual floor tiles. Since the materials are engineered synthetics, the flooring systems may comprise durable plastics that are extremely durable, that are resistant to environmental conditions, and that provide long-lasting wear even in outdoor installations. These flooring assemblies generally require little maintenance as compared to more traditional flooring, such as wood.

Still another advantage is that synthetic flooring systems are generally better at absorbing impact than other long-lasting flooring alternatives, such as asphalt and concrete. Better impact absorption translates into a reduction of the likelihood or risk of injury in the event a person falls. Synthetic flooring systems may further be engineered to provide more or less shock absorption, depending upon various factors such as intended use, cost, etc. In a related advantage, the interlocking connections or interconnects for modular flooring assemblies can be specially engineered to absorb various applied forces, such as lateral forces, which can reduce certain types of injuries from athletic or other activities.

Unlike traditional flooring made from asphalt, wood, or concrete, modular synthetic flooring systems present certain unique challenges. Due to their ability to be engineered, the configuration and material makeup of individual floor tiles varies greatly. As a result, the performance or performance characteristics provided by these types of floor tiles, and the corresponding flooring systems created from them, also greatly varies. There are two primary performance characteristics, beyond those described above (e.g., shock absorption), that are considered in the design and construction of synthetic floor tiles—1) traction or grip of the contact surface, which is a measure of the coefficient of friction of the contact surface; and 2) contact surface abrasiveness, which is a measure of how much the contact surface abrades a given object that is dragged over the surface.

In order for the contact surface of a flooring system to provide high performance characteristics, such as those that would enable athletes to quickly start, stop, and turn, the contact surface must provide good traction. Currently, efforts have been undertaken to improve the traction of synthetic flooring systems. Such efforts have included forming nubs or a pattern of protrusions that extend upward from the contact surface of the individual floor tiles. However, such nubs or protrusions, while providing somewhat of an improvement in traction over the same surface without such nubs, significantly increases the abrasiveness of the contact surface, and therefore the likelihood of injury in the event of a fall. Indeed, such nubs create a rough or coarse surface. In addition, the existence of nubs or protrusions creates irregular or uneven surfaces that may actually reduce traction depending upon their configuration and size.

Another effort undertaken to improve traction has involved forming a degree of texture, particularly an aggressive texture, in the upper or top surfaces of the various structural members or elements defining the contact surface of the flooring system. However, this only marginally improves traction, primarily because the texture, although seemingly aggressive, is unable to be pronounced enough to have any significant effect on the surface area of an object moving about the contact surface. This is particularly the case in the event the object comprises a large surface area (as compared to the surface area of the contact surface) and exerts a large normal force, such as an athlete whose shoe surface area and large normal force almost negate such practices.

With respect to the performance characteristic of abrasiveness of the contact surface of the flooring system, many floor tile designs sacrifice this in favor of improved traction. Indeed, the two most common ways to increase traction discussed above, namely providing raised nubs or other protrusions and providing aggressive texture on the contact surface, function to negatively increase the abrasiveness of the floor tiles and the flooring system in most prior art floor tiles. Thus, although a flooring system may provide good traction, there is most likely a higher risk for injury in the event of a fall due to the abrasive nature of the flooring system.

Abrasiveness may further be compounded by the sharp edges existing about the tile. Indeed, it is not uncommon for individual floor tiles to have a perimeter around and defining the dimensions of the floor tile consisting of two surfaces extending from one another on an orthogonal angle. It is also not uncommon for the various structural members extending between the perimeter and defining the contact surface to also comprise two orthogonal surfaces. Each of these represents a sharp, rough edge likely to abrade, or at least have a tendency to abrade, any object that is dragged over these edges under any amount of force. The combination of current traction enhancing methods along with the edges of sharp perimeter and structural members, all contribute to a more abrasive contact surface.

SUMMARY OF THE INVENTION

In light of the problems and deficiencies inherent in the prior art, the present invention seeks to overcome these by providing a unique floor tile designed to provide an increase of traction without the abrasiveness of prior related floor tiles. Rather than providing raised nubs or an abrasive aggressive texture to increase traction about the contact surface of the floor tile, the present invention increases traction by increasing coefficient of friction about the contact surface. Coefficient of friction may be increased by striking an optimized balance between the surface area and the openings of the contact surface. Stated differently, the coefficient of friction of the contact surface may be manipulated by manipulating various design factors, such as the size of the contact surface openings, the geometry of such openings, as well as the size and configuration of the various structural members defining such openings. Each of these, either individually or collectively, function to affect the coefficient of friction depending on their configuration. In any given embodiment, each of these parameters may be manipulated and optimized to provide a floor tile having enhanced performance characteristics.

A floor tile formed in accordance with an effort to optimize the above parameters also benefits from being much less abrasive as compared to other prior related floor tiles. Abrasiveness is further reduced by providing blunt edges or transition surfaces along the perimeter of the floor tile, as well as the various structural members defining the openings and contact surface.

In accordance with the invention as embodied and broadly described herein, the present invention features a modular synthetic floor tile comprising: (a) an upper contact surface; (b) a plurality of openings formed in the upper contact surface, each of the openings having a geometry defined by structural members configured to intersect with one another at various intersection points to form at least one acute angle as measured between imaginary axes extending through the intersection points, the structural members having a smooth, planar top surface forming the contact surface, and a face oriented transverse to the top surface; (c) a transition surface extending between the top surface and the face of the structural members configured to provide a blunt edge between the top surface and the face, and to reduce abrasiveness of the floor tile; and (d) means for coupling the floor tile to at least one other floor tile.

The present invention also features a modular synthetic floor tile comprising: (a) a perimeter; (b) an upper contact surface contained, at least partially, within the perimeter; (c) a first series of structural members extending between the perimeter; (d) a second series of structural members extending between the perimeter, and intersecting the first series of structural members in a manner so as to form a plurality of openings in the upper contact surface, each of the openings having a configuration selected from a diamond and diamond-like geometry defined by the intersection of the first and second series of structural members, the first and second series of structural members comprising a smooth, planar top surface, a face oriented transverse to the top surface, and a transition surface extending between the top surface and the face to provide the structural members with a blunt edge configured to reduce abrasiveness of the floor tile; and (e) means for coupling the floor tile to at least one other floor tile.

The present invention further features a modular synthetic floor tile comprising: (a) an upper contact surface; (b) a perimeter surrounding the upper contact surface, the perimeter having a blunt edge configured to soften the interface between the floor tile and an adjacent floor tile; (c) a plurality of recurring openings formed in the upper contact surface, each of the openings having a diamond shaped geometry defined by structural members configured to intersect with one another at various intersection points, the structural members having a smooth, planar top surface forming the contact surface, and a face oriented transverse to the top surface; (d) a curved transition surface extending between the top surface and the face of the structural members configured to provide a blunt edge between the top surface and the face, and to reduce the abrasiveness of the floor tile; and (e) means for coupling the floor tile to at least one other floor tile.

The present invention still further features a method for enhancing the performance characteristics of a modular synthetic floor tile, the method comprising: (a) providing a plurality of structural members to form an upper contact surface; (b) configuring the structural members to intersect one another at intersection points and to define a plurality of openings having at least one acute angle as measured between imaginary axes extending through the intersection points, the openings wedging configured to receive and wedge at least a portion of an object acting on the contact surface to provide increased traction about the contact surface, the structural members having a top surface forming the contact surface, and a face oriented transverse to the top surface; and (c) configuring the structural members with a transition surface extending between the top surface and the face to provide the structural members with a blunt edge configured to reduce abrasiveness of the floor tile.

The present invention still further features a method for enhancing the performance characteristics of a modular synthetic floor tile, the method comprising: (a) providing a plurality of structural members configured to form a smooth, planar upper contact surface having a plurality of openings; (b) optimizing a ratio of surface area of the structural members to an open area of the openings to satisfy a pre-determined threshold coefficient of friction of the contact surface; and (c) optimizing a configuration of a transition surface with respect to the surface area to satisfy a pre-determined threshold of abrasiveness.

BRIEF DESCRIPTION OF THE DRAWINGS

The present invention will become more fully apparent from the following description and appended claims, taken in conjunction with the accompanying drawings. Understanding that these drawings merely depict exemplary embodiments of the present invention they are, therefore, not to be considered limiting of its scope. It will be readily appreciated that the components of the present invention, as generally described and illustrated in the figures herein, could be arranged and designed in a wide variety of different configurations. Nonetheless, the invention will be described and explained with additional specificity and detail through the use of the accompanying drawings in which:

FIG. 1-B illustrates a cut-away sectional view of the exemplary floor tile of FIG. 1-A;

FIG. 13-B illustrates a partial sectional side view of the exemplary floor tile of FIG. 8;

DETAILED DESCRIPTION OF EXEMPLARY EMBODIMENTS

Figures 1A, 1B:
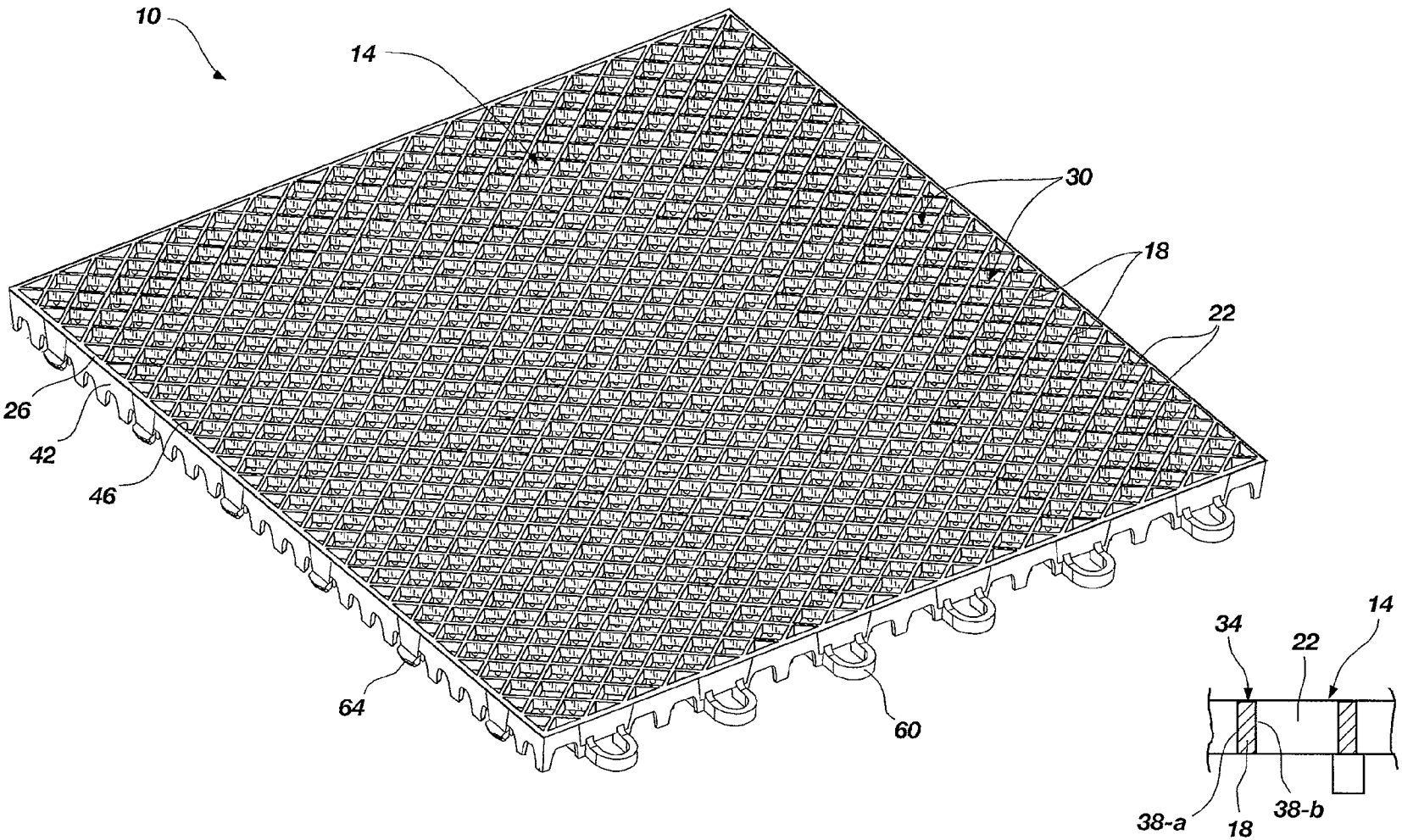
FIG. 1-A illustrates a perspective view of a modular synthetic floor tile in accordance with one exemplary embodiment of the present invention.
Figure 2:
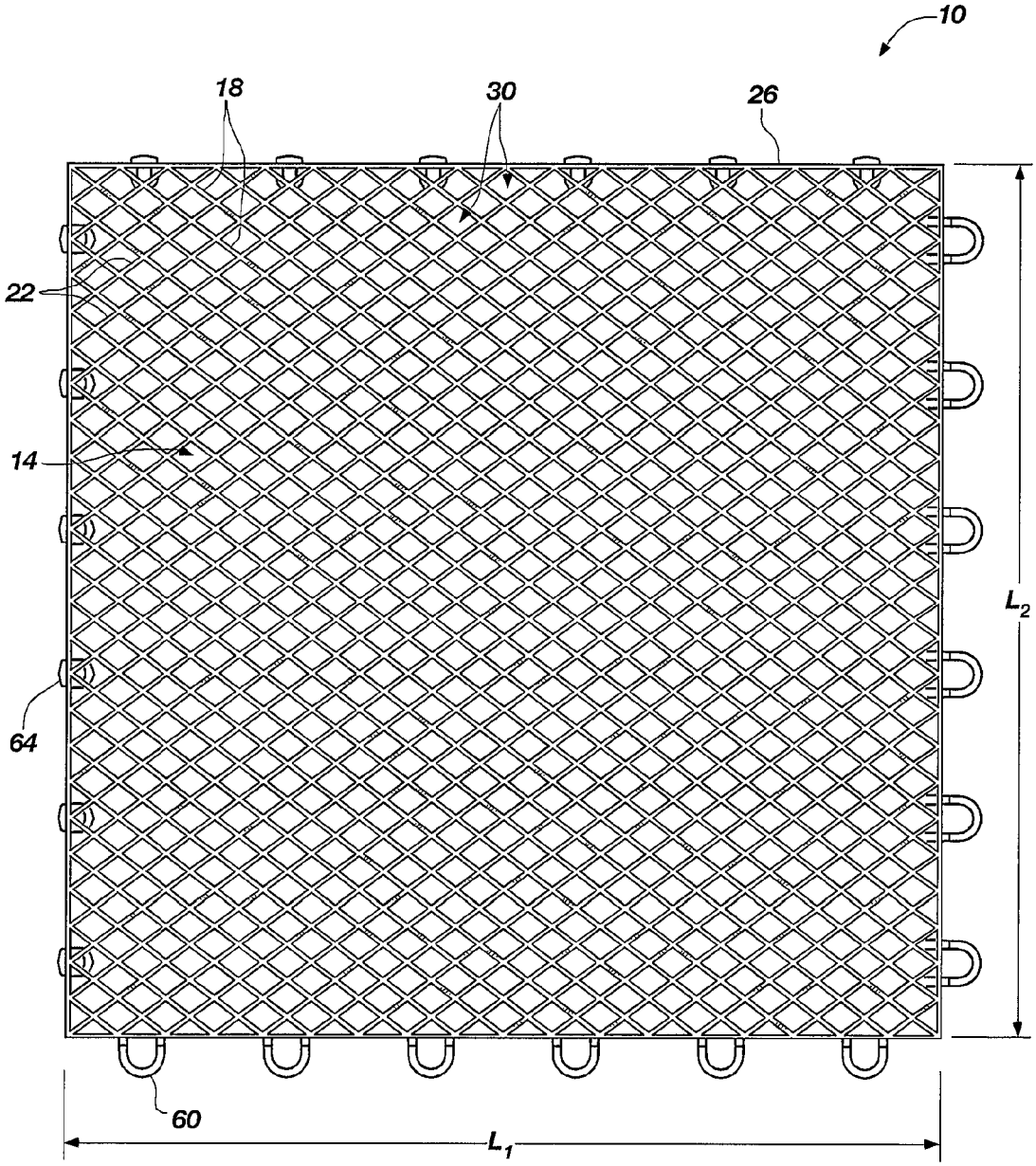
FIG. 2 illustrates a top view of the exemplary floor tile of FIG. 1-A.
Figure 3:
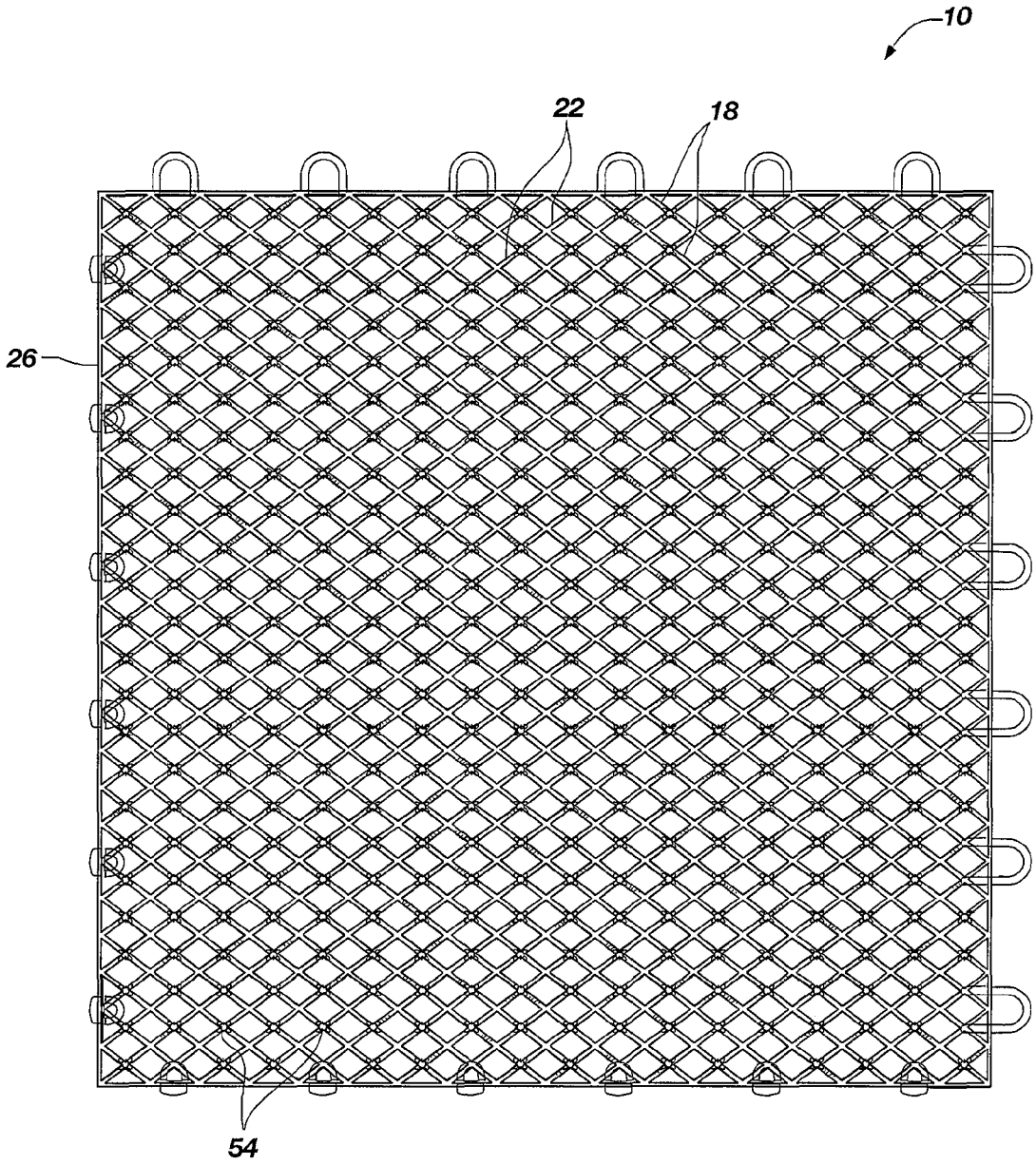
FIG. 3 illustrates a bottom view of the exemplary floor tile of FIG. 1-A.
Figure 4:
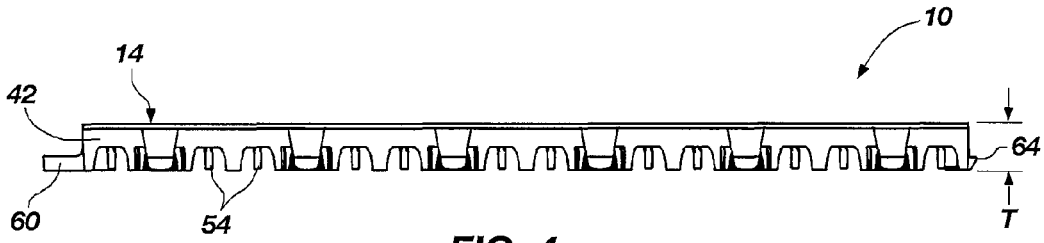
FIG. 4 illustrates a first side view of the exemplary floor tile of FIG. 1-A.
Figure 5:
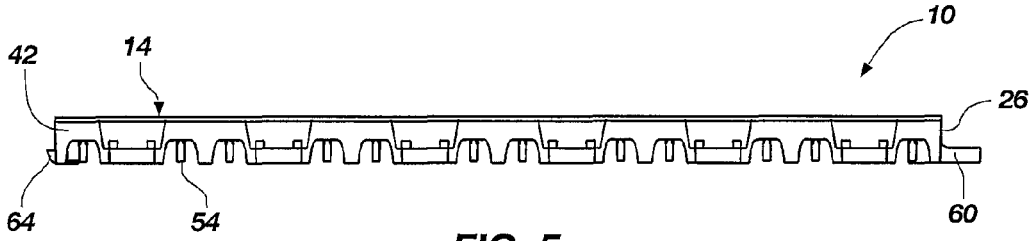
FIG. 5 illustrates a second side view of the exemplary floor tile of FIG. 1-A.
Figure 6:
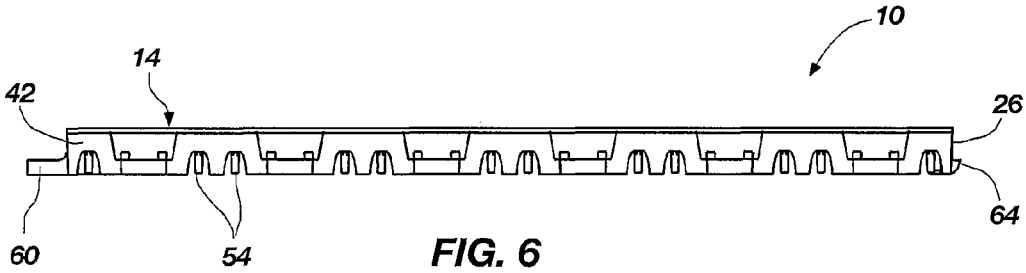
FIG. 6 illustrates a third side view of the exemplary floor tile of FIG. 1-A.
Figure 7:
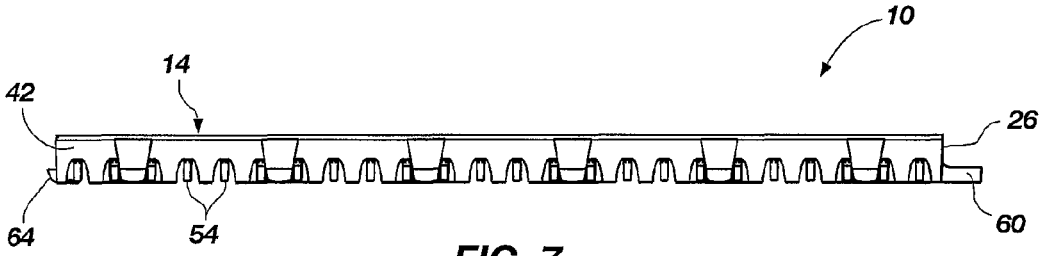
FIG. 7 illustrates a fourth side view of the exemplary floor tile of FIG. 1-A.
Figure 8:
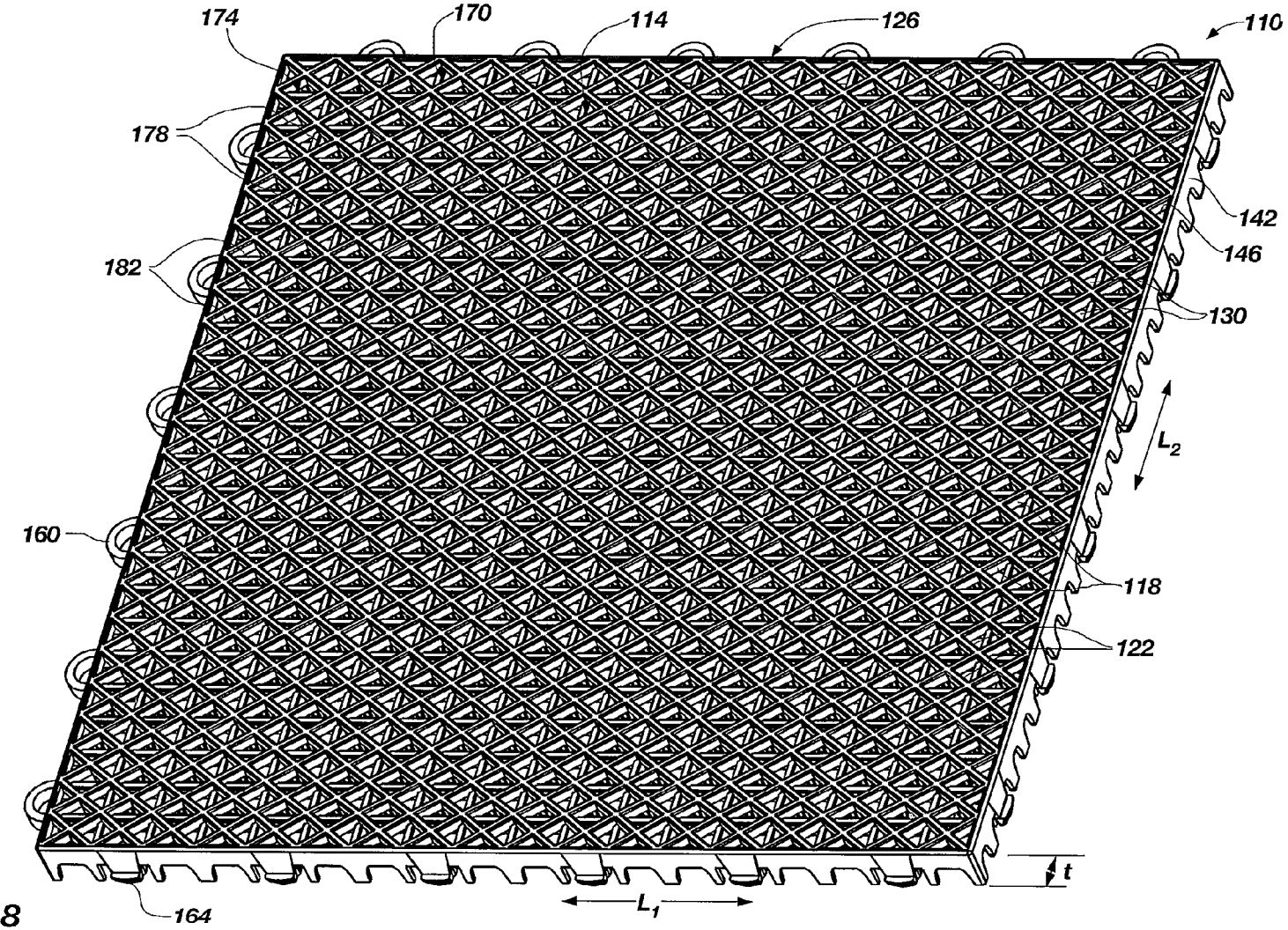
FIG. 8 illustrates a perspective view of a modular synthetic floor tile in accordance with another exemplary embodiment of the present invention.
Figure 9:
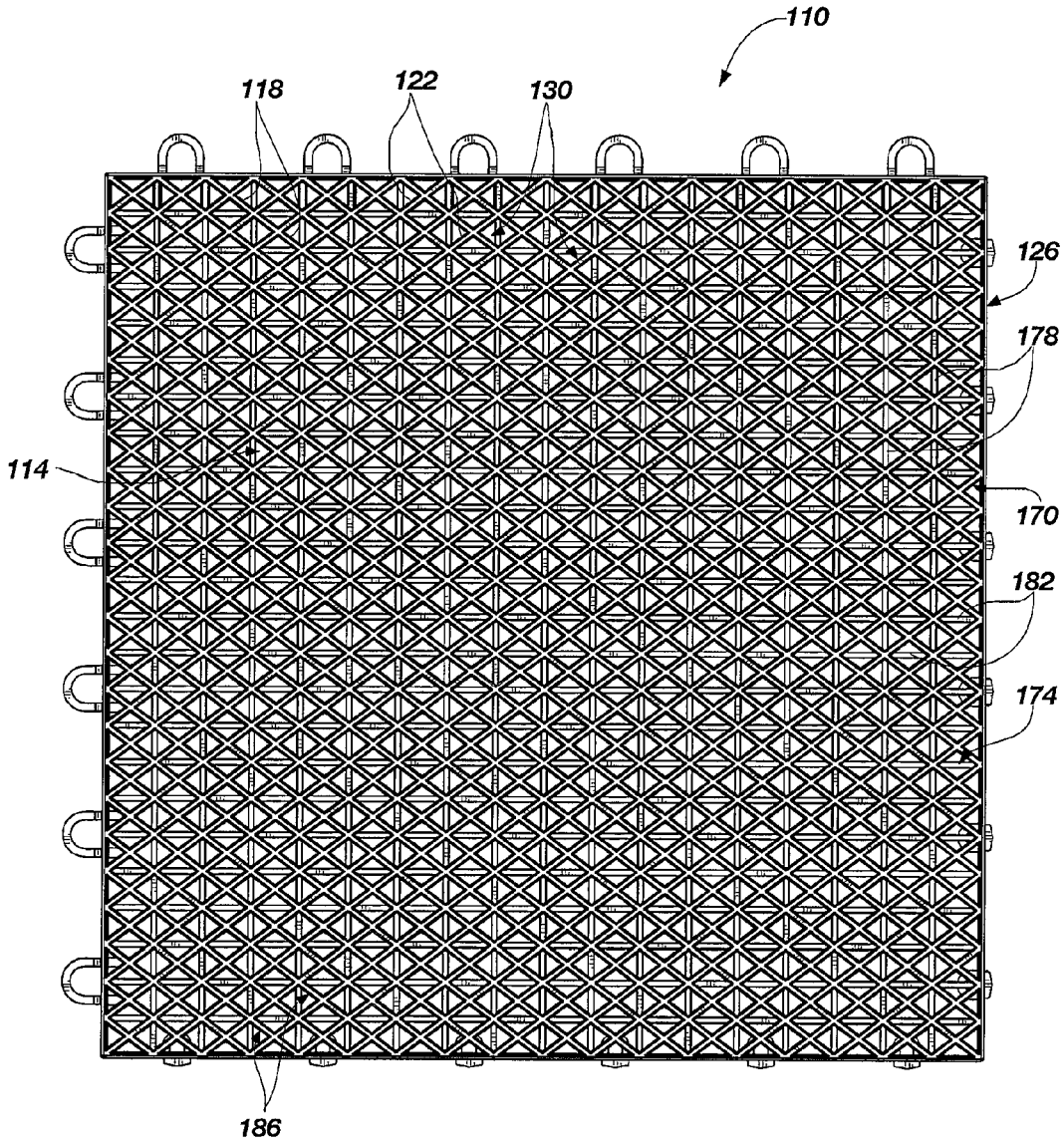
FIG. 9 illustrates a top view of the exemplary floor tile of FIG. 8.
Figure 10:
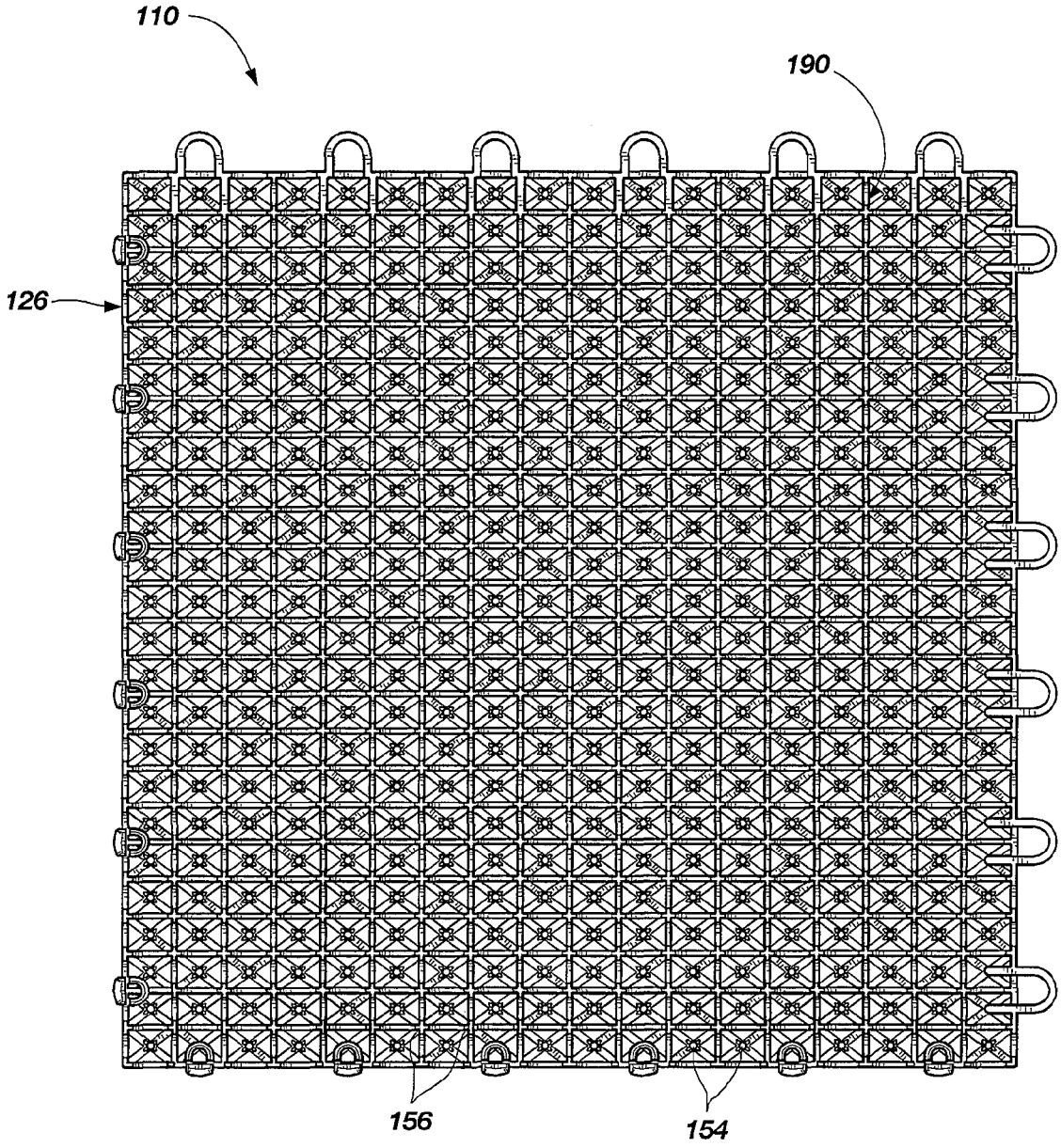
FIG. 10 illustrates bottom view of the exemplary floor tile of FIG. 8.
Figure 11:
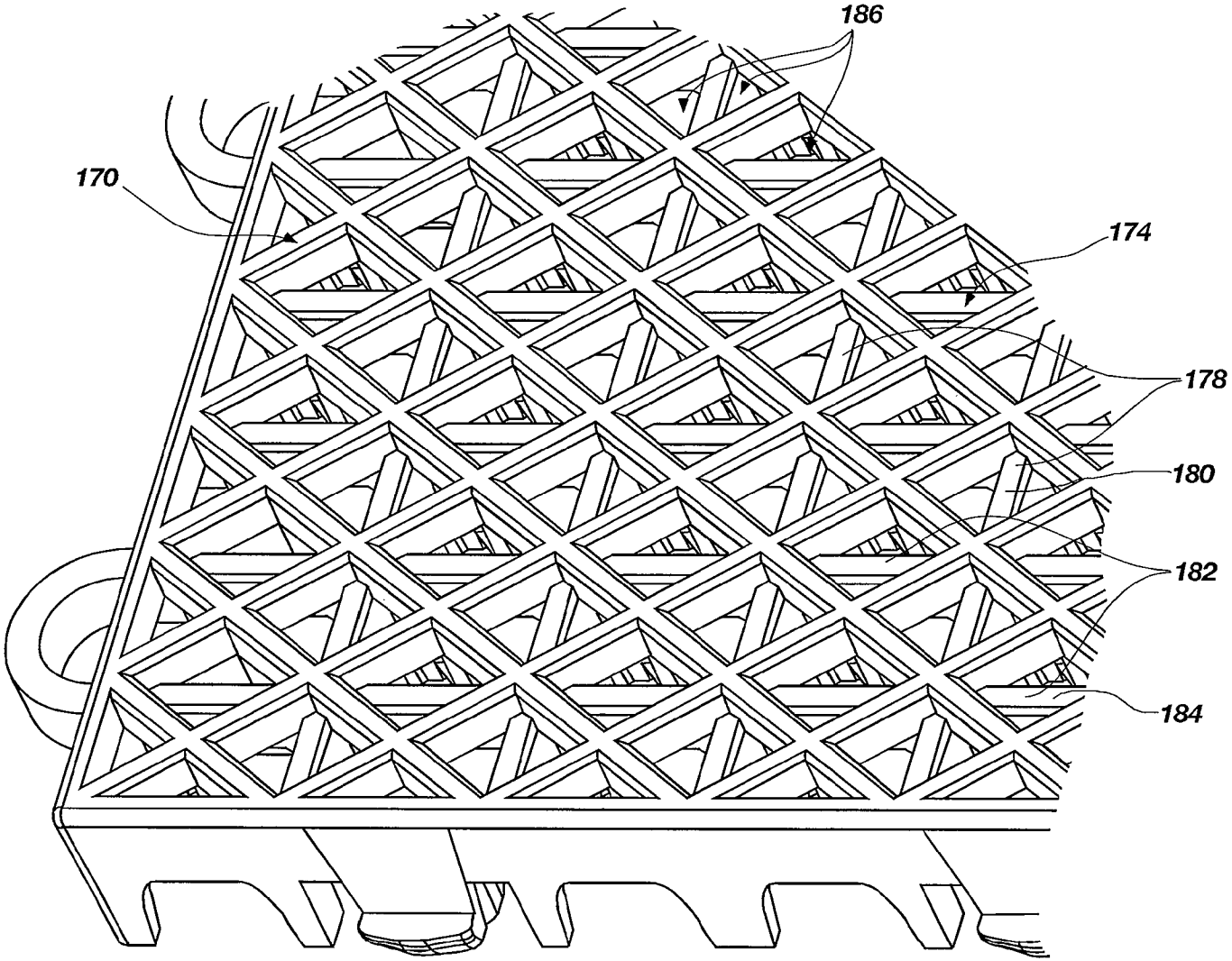
FIG. 11 illustrates a partial detailed perspective view of the exemplary floor tile of FIG. 8.
Figure 12:
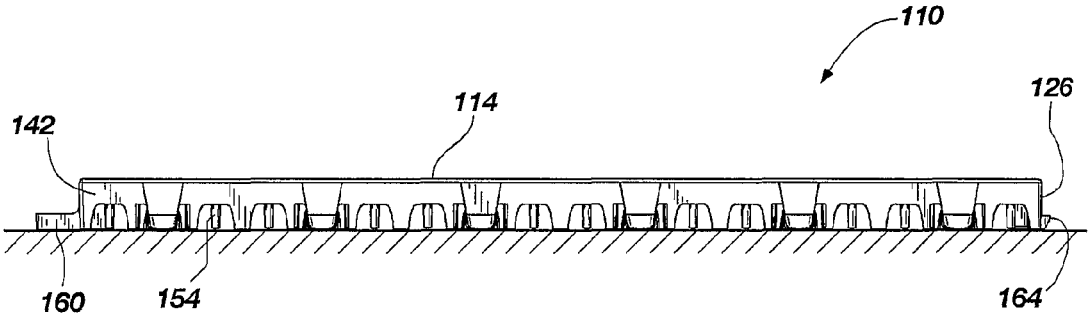
FIG. 12 illustrates a side view of the exemplary floor tile of FIG. 8.

The following detailed description of exemplary embodiments of the invention makes reference to the accompanying drawings, which form a part hereof and in which are shown, by way of illustration, exemplary embodiments in which the invention may be practiced. While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

The following detailed description and exemplary embodiments of the invention will be best understood by reference to the accompanying drawings, wherein the elements and features of the invention are designated by numerals throughout.

The present invention describes a method and system for enhancing the performance characteristics of a synthetic flooring system comprising a plurality of individual modular floor tiles. The present invention discusses various design factors or parameters that may be manipulated to effectively enhance, or even optimize, the performance characteristics of individual modular floor tiles, and the resulting assembled flooring system. Although a floor tile possesses many performance characteristics, those of coefficient of friction and abrasiveness are the focus of the present invention.

Generally speaking, it is believed that the coefficient of friction of a modular synthetic floor tile may be enhanced by balancing and manipulating various design considerations or parameters, namely the surface area of the upper contact surface, the size of some or all of the openings of the floor tile (e.g., the ratio of surface area to opening or opening area), and the geometry of some or all of the openings in the contact surface of the floor tile. Other design parameters, such as material makeup, area also important considerations.

With respect to the surface area of the upper contact surface, and particularly the various structural members making up or defining the upper contact surface, it has been found that the coefficient of friction or traction of a floor tile, and ultimately an assembled flooring system, may be enhanced by manipulating the ratio of surface area to opening area (which is directly related to or dependant on the size of the openings). A floor tile comprising a plurality of openings formed in its contact surface for one or more purposes (e.g., to facilitate water drainage, etc.) will obviously sacrifice to some extent the quantity of surface area compared to the quantity of opening area. However, the size of the openings and the thickness of the top surfaces of the structural members making up the openings (which top surfaces define the upper contact surface, and particularly the surface area of the upper contact surface) may be manipulated to achieve a floor tile have more or less coefficient of friction.

With respect to the size of the openings in the upper contact surface, these also can be manipulated to enhance the coefficient of friction. It has been discovered that the openings can be configured to receive and apply a compression force to objects acting on or moving about the contact surface of the floor tile that are sufficiently pliable. Openings too small may not adequately receive an object, while openings too large may limit the area of the object being acted on by the openings.

Finally, with respect to the geometry of the openings in the upper contact surface, it has been discovered that certain openings are able to enhance the coefficient of friction of a floor tile better than others. Specifically, openings having at least one acute angle (as defined below) function to enhance the coefficient of friction by applying a compression force to suitably pliable objects acting on or moving about the contact surface. By providing at least one acute angle in some or all of the openings of a modular synthetic floor tile, the openings are able to essentially wedge a portion of the object in those segments of the opening formed on the acute angle. By doing so, one or more compression forces are induced and caused to act on the object, which compression forces function to increase the coefficient of friction.

It is contemplated that all of these design parameters may be carefully considered and balanced for a given floor tile. It is also contemplated that each of these design parameters may be optimized for a given floor tile design. Optimized does not necessarily mean maximized. Indeed, although it will most likely always be desirable to maximize the coefficient of friction of a particular floor tile, this may not necessarily mean that each of the above-identified design parameters is maximized to achieve this. For a given floor tile, the coefficient of friction may be best enhanced by some design parameters giving way to some extent to other design parameters. Thus each one is to be carefully considered for each floor tile design. In addition, there may be instances where the coefficient of friction may not always be maximized. For example, aesthetic constraints may trump the ability to maximize the coefficient of friction. In any case, it is contemplated that by manipulating the above-identified design parameters that the coefficient of friction for any given floor tile may be enhanced, or optimized, to some degree.

To illustrate, it may not be possible, in some instances, to maximize the ratio of surface area to opening area for a particular floor tile. However, this does not mean that the ratio cannot nevertheless be optimized. By optimizing this ratio, taking into account all other design parameters, the overall coefficient of friction of the floor tile may be enhanced to some degree, even in light of other overriding factors.

It has also been discovered that the coefficient of friction can be enhanced without the need for providing texture in the contact surface, as exists in many prior related designs. Indeed, the present invention advantageously provides a flat, planar contact surface without texture to achieve an enhanced coefficient of friction. As discussed above, in some cases texture can reduce the coefficient of friction of the floor tile, thus making objects acting on the contact surface more prone to slipping. By providing a flat, planar contact surface, the entire surface area is able to come into contact with an object.

In a related aspect, it has been discovered that the coefficient of friction of a floor tile can be enhanced without the need for additional raised or protruding members extending upward from the contact surface, as also is provided in many prior related designs.

Generally speaking, the abrasiveness of a floor tile, and subsequent assembled flooring system, may be reduced by reducing the tendency of the floor tile to abrade an object acting on or moving about the contact surface of the floor tile. By forming various transition surfaces between each of the edges and top surfaces of the structural members and the perimeter, a softer, smoother contact surface is created. In addition, the interface between adjacent tiles is also softened due to the transition surface along the perimeter.

Definitions

The term "tile performance" or "performance characteristic," as used herein, shall be understood to mean certain measurable characteristics of a flooring system or the individual floor tiles making up the flooring system, such as grip or traction, ball bounce, abrasiveness, shock absorption, durability, wearability, etc. As can be seen, this applies to both physical related characteristics (e.g., those types of characteristics that enable the flooring system to provide a good playing surface, or that affect the performance of objects or individuals acting on or traveling about the playing surface), and safety related characteristics (e.g., those types of characteristics of the floor tile that have a tendency to minimize the potential for injury). For example, traction may be described as a physical performance characteristic that contributes to the level of play that is possible about the contact surface. Abrasiveness may be termed a safety related performance characteristic although it is not necessarily an indicator of how well the flooring system is going to affect or enable sports or activity play and at what level. Nonetheless, the ability to minimize injury, and thus enable safe play, particularly in the event of a fall, is an important consideration.

The term "traction," as used herein, shall be understood to mean the measurement of coefficient of friction of the flooring system (or individual floor tiles) about its contact surface.

The terms "abrasive" or "abrasiveness," as used herein, shall be understood to mean the tendency of the flooring system (or individual floor tiles) to abrade or chafe an the surface of an object that drags or is dragged across its contact surface.

The term "acute," as used herein, shall be understood to mean an angle or segment of structural members intersecting one another on an angle less than 90°. The reference to acute does not necessarily mean an angle and does not necessarily mean a segment of an opening formed by two linear support members. An opening may comprise an acute angle (even though its defining structural members are nonlinear) as it is understood that an acute angle is measured between imaginary axes extending through three or more intersection points of the structural members defining an opening.

The term "obtuse," as used herein, shall be understood to mean an angle or segment of structural members intersecting one another on an angle greater than 90°. The reference to obtuse does not necessarily mean an angle and does not necessarily mean a segment of an opening formed by two linear support members. An opening may comprise an obtuse angle (even though its defining structural members are nonlinear) as it is understood that an obtuse angle is measured between imaginary axes extending through three or more intersection points of the structural members defining an opening.

The term "transition surface," as used herein, shall be understood to mean a surface or edge extending between a top surface of a structural member or perimeter member, and a face or side of that member to provide a soft or blunt transition between the top surface and the face. Such a transition surface functions to reduce the abrasiveness of the flooring system. A transition surface may comprise a linear segment, a round segment having a radius or an arc to provide a rounded edge, or any combination of these.

The term "diamond-like," as used herein, shall be understood to mean any closed geometric shape having at least one obtuse angle and at least one acute angle.

The term "opening area" or "area of the opening(s)," as used herein, shall be understood to mean the calculated or quantifiable area or size of the open space or void in the opening as defined by the structural members making up the opening and defining its boundaries. Commonly known area calculations are intended to provide the area of the opening(s) measured in any desirable units—$[\text{unit}]^2$.

Traction and Abrasiveness

One of the more important challenges in the construction of synthetic floor tiles and corresponding flooring systems is the need to provide a contact surface having adequate traction or grip. Traction refers to the friction existing between a drive member and the surface it moves upon, where the friction is used to provide motion. In other words, traction may be thought of as the resistance to lateral motion when one attempts to slide the surface of one object over another surface. Traction is particularly important where the synthetic flooring system is to be used for one or more sports-related or other similar activities.

The level of traction a particular flooring system (or individual floor tile) provides may be described in terms of its measured coefficient of friction. As is will known, coefficient of friction may be defined as a measure of the slipperiness between two surfaces, wherein the larger the coefficient of friction, the less slippery the surfaces are with respect to one another. One factor affecting coefficient of friction (or traction) is the magnitude of the normal force acting on one or both of the objects having the two surfaces, which normal force may be thought of as the force pressing the two objects, and therefore the two surfaces, together. Another factor affecting coefficient of friction is the type of material from which the surfaces are formed. Indeed, some materials are more slippery than others. To illustrate these two factors, pulling a heavy wooden block (one having a large normal force) across a surface requires more force than does pulling a light block (one having a smaller normal force) across the same surface. And, pulling a wooden block across a surface of rubber (large coefficient of friction) requires more force than pulling the same block across a surface of ice (small coefficient of friction).

For a given pair of surfaces, there are two types of friction coefficient. The coefficient of static friction, $\mu_s$, applies when the surfaces are at rest with respect to one another, while the coefficient of kinetic friction, $\mu_k$, applies when one surface is sliding across the other.

The maximum possible friction force between two surfaces before sliding begins is the product of the coefficient of static friction and the normal force: $F_{max}=\mu_s N$. It is important to realize that when sliding is not occurring, the friction force can have any value from zero up to $F_{max}$. Any force smaller than $F_{max}$ attempting to slide one surface over the other will be opposed by a frictional force of equal magnitude and opposite in direction. Any force larger than $F_{max}$ will overcome friction and cause sliding to occur.

When one surface is sliding over the other, the friction force between them is always the same, and is given by the product of the coefficient of kinetic friction and the normal force: $F=\mu_k N$. The coefficient of static friction is larger than the coefficient of kinetic friction, meaning it takes more force to make surfaces start sliding over each other than it does to keep them sliding once started.

These empirical relationships are only approximations. They do not hold exactly. For example, the friction between surfaces sliding over each other may depend to some extent on the contact area, or on the sliding velocity. The friction force is electromagnetic in origin, meaning atoms of one surface function to "stick" to atoms of the other surface briefly before snapping apart, thus causing atomic vibrations, and thus transforming the work needed to maintain the sliding into heat. However, despite the complexity of the fundamental physics behind friction, the relationships are accurate enough to be useful in many applications.

If an object is on a level surface and the force tending to cause it to slide is horizontal, the normal force N between the object and the surface is just its weight, which is equal to its mass multiplied by the acceleration due to earth's gravity, g. If the object is on a tilted surface such as an inclined plane, the normal force is less because less of the force of gravity is perpendicular to the face of the plane. Therefore, the normal force, and ultimately the frictional force, may be determined using vector analysis, usually via a free body diagram. Depending on the situation, the calculation of the normal force may include forces other than gravity.

Material makeup also affects the coefficient of friction of an object. In most applications, there is a complicated set of trade-offs in choosing materials. For example, soft rubbers often provide better traction, but also wear faster and have higher losses when flexed—thus hurting efficiency.

Another important challenge in the production of synthetic flooring systems is the reduction of the abrasiveness of the contact surface. Abrasiveness may be thought of as the degree to which a surface tends to abrade the surface of an object being dragged over the surface. A common test for abrasiveness of a surface comprises dragging a friable block over the surface under a given load. This is done in all directions over the surface. The block is then removed and weighed to determine its change in weight from before the test. The change in weight represents the amount of material that was lost or scrapped from the block.

The more abrasive a floor tile is the more it will have a tendency to abrade the skin and clothes of an individual, and thus cause injury and damage. Therefore, it is desirable to reduce abrasiveness as much as possible. However, because traction is considered more desirable, abrasiveness has often been sacrificed for an increase in traction (e.g., by providing protrusions and/or texture about the contact surface). Unlike many prior art designs, the present invention advantageously provides both an increase in traction and a reduction in abrasiveness.

DESCRIPTION

With reference to FIGS. 1-7, illustrated is a modular synthetic floor tile in accordance with one exemplary embodiment of the present invention. As shown, the floor tile 10 comprises an upper contact surface 14, shown as having a grid-type or lattice configuration, that functions as the primary support or activity surface of the floor tile 10. In other words, the upper contact surface 14 is the primary surface over which objects or people will travel, and that is the primary interface surface with such objects or people. The upper contact surface 14 thus inherently comprises a measurable degree or level of traction and abrasiveness that will contribute to and affect the performance characteristics of the floor tile 10, or more specifically the performance of those objects and people acting on the floor tile 10. The level of traction and abrasiveness of the floor tile is discuss in greater detail below.

The floor tile 10 further comprises a plurality of structural members that make up or define the grid-type upper contact surface 14, and that provide structural support to the upper contact surface 14. In the exemplary embodiment shown, the floor tile 10 comprises a first series of rigid parallel structural members 18 that, although parallel to one another, extend diagonally, or on an incline, with respect to the perimeter 26. The floor tile 10 further comprises a second series of rigid parallel structural members 22 that also, although parallel to one another, extend diagonally, or on an incline, with respect to the perimeter 26. The first and second series of structural members 18 and 22, respectively, are oriented differently and are configured to intersect one another to form and define a plurality of openings 30, each opening 30 having a geometry defined by a portion of the structural members 18 and 22 configured to intersect with one another at various intersection points to form at least one acute angle as measured between imaginary axes extending through the intersection points. In this case, the structural members 18 and 22 are configured to form openings 30 having a diamond shape, in which the structural members that define each individual opening are configured to intersect or converge on one another to form opposing acute angles and opposing obtuse angles, again as measured between imaginary axes extending through the points of intersection of the structural members 18 and 22.

The structural members 18 further comprise a smooth, planar top surface 34 forming at least a portion of the upper contact surface 14, and opposing sides or faces 38-*a* and 38-*b* oriented transverse to the top surface 34 (see FIG. 1-B). In the exemplary embodiment shown, the faces 38-*a* and 38-*b* are oriented in a perpendicular or orthogonal manner with respect to the top surface 34, and intersect the top surface 34. Although not shown in detail, the structural members 22 comprise a similar configuration, each also having a top surface and opposing faces.

As will be discussed below, the structural members used to form the floor tile and to define the contact surface in any embodiment herein may comprise other configurations to define a plurality of differently configured openings in the upper contact surface, or openings having a different geometry. As discussed herein, the present invention provides a way to enhance traction of the contact surface by providing openings that have at least one acute angle, as defined herein. This does not necessarily mean however, that each and every opening in the contact surface will comprise at least one acute angle. Indeed, an upper contact surface may have a plurality of openings, only some of which have at least one acute angle. This may be dictated by the configuration of the structural members and the resulting particular geometry of the openings in the contact surface, as is discussed below and illustrated in FIGS. 21-24.

Circumscribing the upper contact surface 14 and the general dimensions of the floor tile 10 is a perimeter 26, which functions as a boundary for the floor tile 10, as well as an interface with adjacent floor tiles configured to be interconnected with the floor tile 10. The perimeter 26 also comprises a top surface 42 and a face or wall 46, which extends around the floor tile 10. The top surface 42 of the perimeter is generally planar with the top surface of the various structural members 18 and 22. As such, the perimeter 26 and the structural members 18 and 22 each function to define at least a portion of the contact surface 14.

The floor tile 10 is square or approximately square in plan, with a thickness T that is substantially less than the plan dimension $L_1$ and $L_2$. Tile dimensions and material composition will depend upon the specific application to which the tile will be applied. Sport uses, for example, frequently call for floor tiles having a square configuration with side dimensions ($L_1$ and $L_2$) being either 9.8425 inches (metric tile) or 12.00 inches. Obviously, other shapes and dimensions are possible. The thickness T may range between 0.25 and 1 inches, although a thickness T between 0.5 and 0.75 inches is preferred, and considered a good practical thickness for a floor tile such as that depicted in FIG. 1. Other thicknesses are also possible. The floor tiles can be made of many suitable materials, including polyolefins, such as polypropylene, polyurethane and polyethylene, and other polymers, including nylon. Tile performance may dictate the type of material used. For example, some materials provide better traction than other materials, and such should be considered when planning and installing a flooring system.

The floor tile 10 further comprises a support structure (see FIG. 3) designed to support the floor tile 10 about a subfloor or support surface, such as concrete or asphalt. As shown, the bottom of the floor tile 10 comprises a plurality of vertical support posts 54, which give strength to the floor tile 10 while keeping its weight low. The support posts 54 extend down from the underside of the contact surface, and particularly the structural members 18 and 22. The support posts 54 may be located anywhere along the underside of the floor tile surface, and the structural members, but are preferably configured to extend from the points of intersection, each one or a select number, of the structural members, as shown. In addition, the support posts 54 may be any length or offset lengths, and may comprise the same or different material than that of the structural members 18 and 22.

A plurality of coupling elements in the form of loop and pin connectors are disposed along the perimeter wall 46, with loop connectors 60 disposed on two contiguous sides, and pin connectors 64 disposed on opposing contiguous sides. The loop and pin connectors 60 and 64, respectively, are configured to allow interconnection of the floor tile 10 with similar adjacent floor tiles to form a flooring system, in a manner that is well known in the art. It is also contemplated that other types of connectors or coupling means may be used other than those specifically shown and described herein.

With reference to FIGS. 8-13, illustrated is a modular synthetic floor tile in accordance with another exemplary embodiment of the present invention. This particular embodiment is exemplary of the modular synthetic floor tile manufactured and sold by Connor Sport Court International, Inc. of Salt Lake City, Utah under the PowerGame™ trademark. This embodiment is similar to the one described above and illustrated in FIGS. 1-7, but comprises some differences, namely a multiple-level (bi-level to be specific) surface configuration. As such, the description above is incorporated herein, where appropriate. As shown, the floor tile 110 comprises an upper contact surface 114, shown as having a grid-type configuration, that functions as the primary support or activity surface of the floor tile 110. The upper contact surface 114 is similar in function as that described above.

The floor tile 110 further comprises a plurality of structural members that make up or define the grid-type upper contact surface 114, and that provide structural support to the upper contact surface 114. In the exemplary embodiment shown, the floor tile 110 comprises a first series of rigid parallel structural members 118 and a second series of structural members 122 that are similar in configuration and function as those described above.

The first and second series of structural members 118 and 122 are configured to form openings 130 within the contact surface 114 having a diamond shape. As in the embodiment discussed above, the structural members that define each individual opening are configured to intersect or converge on one another to form opposing acute angles and opposing obtuse angles, again as measured between imaginary axes extending through the points of intersection of the structural members 118 and 122.

Figure 13B:
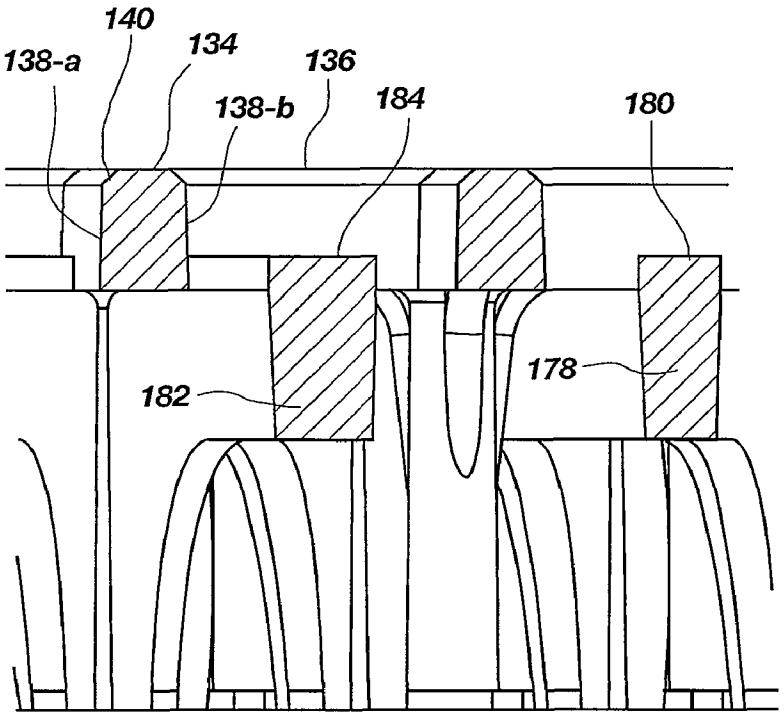
FIG. 13-A illustrates a partial sectional side view of the exemplary floor tile of FIG. 8.
Figure 13A:
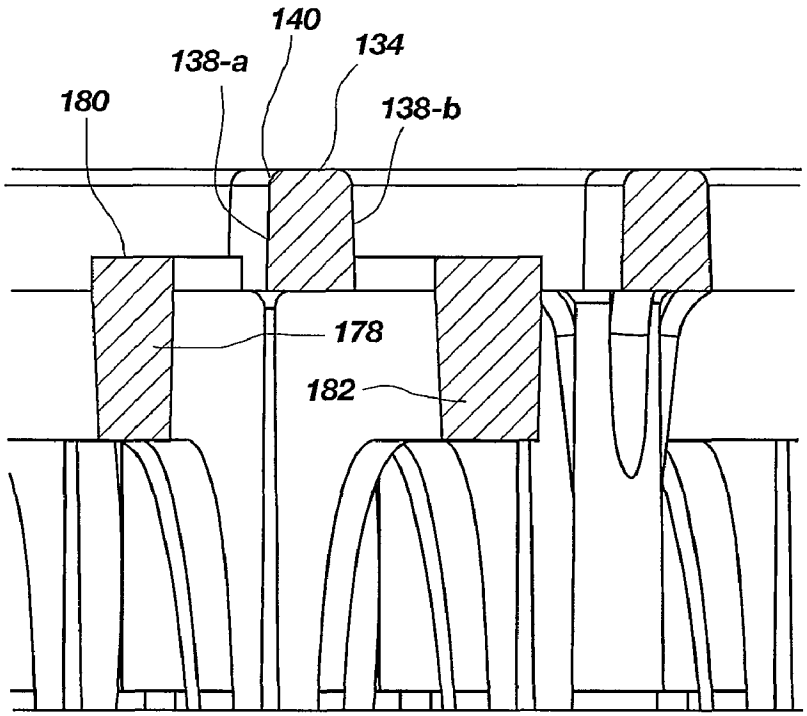

The structural members 118 further comprise a smooth, planar top surface 134 forming at least a portion of the upper contact surface 114, and opposing sides or faces 138-*a* and 138-*b* oriented transverse to the top surface 134 (see FIGS. 13-A and 13-B). The top surface 134 may comprise different widths (as measured along a cross-section of the structural member) that may also be optimized to contribute to the overall enhancement of the coefficient of friction. In the exemplary embodiment shown, the faces 138-*a* and 138-*b* are oriented in a perpendicular or orthogonal manner with respect to the top surface 134, and intersect the top surface 134.

Although not shown in detail, the structural members 122 comprise a similar configuration, each also having a top surface and opposing faces.

Extending between the top surface 134 and each of the faces 138-*a* and 138-*b* is a transition surface designed to eliminate the sharp edge that would otherwise exist between the top surface and the faces. In one exemplary embodiment, the transition surface may comprise a curved configuration, such as an arc or radius (see the transition surface 140 of FIG. 13-A as comprising a radius of 0.02 inches). The radius of a curved transition surface may be between 0.01 and 0.03 inches, and is preferably 0.02 inches. In another aspect, the transition surface may comprise a linear configuration, such as a chamfer, with the linear segment extending downward on an incline from the top surface 134 (see the transition surface 140 of FIG. 13-B as comprising a chamfer). The angle of incline of the linear segment may be anywhere from 5 to 85 degrees, as measured from the horizontal. Still further, the transition segment may comprise a combined linear and non-linear configuration.

In essence, the effect of the transition surface is to soften the edge of the structural members, thus reducing the abrasiveness of the floor tile or the tendency for the floor tile to abrade an object drug over its surface.

Circumscribing the upper contact surface 114 and the general dimensions of the floor tile 110 is a perimeter 126, which comprises a similar configuration and function as the one described above. Specifically, the perimeter 126 comprises a top surface 142 and a face or wall 146, which extends around the floor tile 110. Like the various structural members, the perimeter may also comprise a transition surface having a curved or linear configuration that extends between the top surface 143 and the face 146. In the embodiment shown, the perimeter comprises a transition surface having a radius of 0.02 inches. This further contributes to a reduction in overall abrasiveness of the tile, as well as softens the interface between adjacent floor tiles.

The floor tile 110 is square or approximately square in plan, with a thickness T that is substantially less than the plan dimension $L_1$ and $L_2$.

Unlike the floor tile 10 illustrated in FIGS. 1-7, the floor tile 110 comprises a bi-level surface configuration comprised of first and second surface levels. The first surface level comprises an upper surface level configuration 170 (hereinafter upper surface level) and a lower surface level configuration 174 (hereinafter lower surface level). The upper surface level 170 comprises and is defined by the first and second series of structural members 118 and 122, and further defines the upper contact surface 114.

The lower surface level 174 also comprises first and second series of structural members 178 and 182, each of which comprise a plurality of individual, parallel structural members. The first series of structural members 178 is oriented orthogonal or perpendicular to the second series of structural members 182, and each of the first and series of structural members 178 and 182 are oriented orthogonal or perpendicular to respective segments of the perimeter 126.

The lower surface level 174 comprises a grid-like or lattice configuration that is oriented generally transverse to the upper surface level 170, which also comprises a grid-like or lattice configuration, so as to provide additional strength to the upper contact surface 114, as well as to provide additional benefits.

The upper and lower surface levels 170 and 174, respectively, are integrally formed with one another and provide a grid extending within the perimeter 126 with drainage gaps 186 formed therethrough (see FIGS. 9 and 11), which drainage gaps 186 are defined by the relationship between the structural members of the upper and lower surface levels 170 and 174 and any openings formed by these. The drainage gaps 186 can have a minimum dimension selected so as to resist the entrance of debris, such as leaves, tree seeds, etc., which could clog the drainage pathways below the top surface of the tile, yet still provide for adequate drainage of water.

With reference to FIGS. 8-11, 13-A and 13-B, advantageously, the first and second series of structural members 178 and 182, respectively, of the lower surface level 174 each have a top surface 180 and 184, respectively, that is below the top surfaces 134 and 136 of the first and second series of structural members 118 and 122 of the upper surface level 170, as well as the contact surface 114, so as to draw residual moisture from the contact surface 114. Specifically, the surface tension of water droplets naturally tends to draw the droplets down to the lower surface level 174, so that if drops hang in the drainage openings 186, they will tend to hang adjacent to the lower surface level 174, rather than the upper surface level 170, thus reducing the persistence of moisture on the upper contact surface 114, making the flooring system usable sooner after wetting, and thus further enhancing the traction along the upper contact surface 114. The lower surface level also functions to break the surface tension of water droplets, thus facilitating the drawing of the water to the one or more lower surface levels.

In one embodiment, the top surfaces 180 and 184 of the lower surface level 174 are disposed about 0.10 inches below the top surfaces 134 and 136 of the upper surface level 170. The inventors have found this dimension to be a practical and functional dimension, but the tile is not limited to this. In the embodiment depicted in the figures, the upper surface level 170 and lower surface level 174 have a substantially coplanar underside 190, with the upper surface level 170 thus comprising a thickness that is about twice that of the lower surface level 174.

The floor tile 110 further comprises a support structure (see FIG. 10) extending down from the underside 190. As discussed above, the support structure is designed to support the floor tile 110 about a subfloor or support surface, such as concrete or asphalt. The bottom or underside 190 of the floor tile 110 comprises a plurality of vertical support posts 154, which give strength to the floor tile 110 while keeping its weight low. The support posts 154 extend down from the underside of the contact surface, and particularly from the structural members 118 and 122. The support posts 154 may be located anywhere along the underside of the floor tile surface, and the structural members, but are preferably configured to extend from the points of intersection, each one or a select number, of the structural members 118 and 122, as shown. In addition, the support posts 154 may be any length or offset lengths, and may comprise the same or different material than that of the structural members 118 and 122.

The floor tile 110 comprises a plurality of secondary support posts 154 that extend down from the intersection of the first and second series of structural members 178 and 182 of the lower surface level 174. The secondary support posts 156 are shown as terminating at a different elevation from the support posts 154.

A plurality of coupling elements in the form of loop and pin connectors are disposed along the perimeter wall 146, with loop connectors 160 disposed on two contiguous sides, and pin connectors 164 disposed on opposing contiguous sides.

Figure 14:
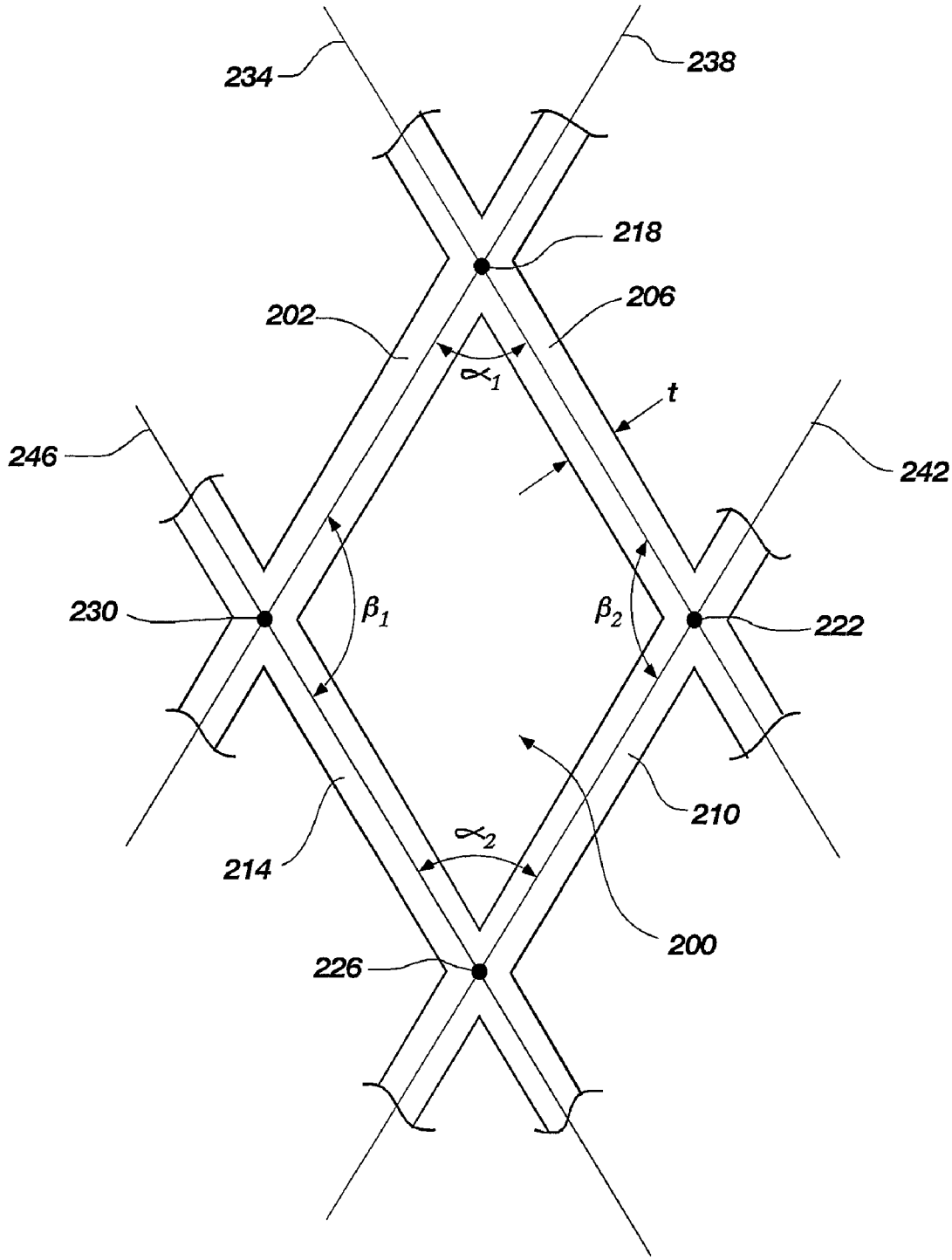
FIG. 14 illustrates a partial top view of an exemplary floor tile having a diamond shaped opening.

With reference to FIG. 14, illustrated is a detailed top view of an opening in a contact surface of a floor tile in accordance with one exemplary embodiment of the present invention. The opening 200 is defined by a plurality of linear structural members, having a thickness t, shown as structural members 202, 206, 210, and 214. The structural members are configured to intersect one another at a plurality of intersection points to define the size and geometry of the opening 200. Specifically, structural members 202 and 206 are configured to intersect one another at intersection point 218; structural members 206 and 210 are configured to intersect one another at intersection point 222; structural members 210 and 214 are configured to intersect one another at intersection point 226; structural members 214 and 202 are configured to intersect one another at intersection point 230.

Furthermore, structural member 202 is configured to intersect structural member 206 to form an acute angle $\alpha_1$ as measured between an imaginary longitudinal axis 234 of structural member 206 and an imaginary longitudinal axis 238 of structural number 202; structural member 210 is configured to intersect structural member 214 to form an acute angle $\alpha_2$ as measured between an imaginary longitudinal axis 242 of structural member 210 and an imaginary longitudinal axis 246 structural members 214; structural member 202 is configured to intersect structural member 214 to form an obtuse angle $\beta_1$ as measured between an imaginary longitudinal axis 238 of structural number 202 and an imaginary longitudinal axis 246 of structural member 214; structural member 206 is configured to intersect structural member 210 to form an obtuse angle $\beta_2$ as measured between an imaginary longitudinal axis 234 of structural member 206 and an imaginary longitudinal axis 242 of structural member 210. In accordance with this configuration, opening 200 is formed and defined to comprise two opposing acute angles and two opposing obtuse angles, thus forming a diamond shaped geometry.

Depending on the particular design of the floor tile, the obtuse angles $\beta_1$ and $\beta_2$ may be between 95 and 175 degrees, and preferably between 100 and 140 degrees. Likewise, the acute angles $\alpha_1$ and $\alpha_2$ may be between 5 and 85 degrees, and preferably between 40 and 80 degrees. In the embodiment shown in FIG. 14, the acute angles $\alpha_1$ and $\alpha_2$ are each 74 degrees, and the obtuse angles $\beta_1$ and $\beta_2$ are each 106 degrees. These angles correspond also to the openings in the exemplary floor tiles illustrated in FIGS. 1-13.

The present invention is intended to set forth the significance of one or more openings of a modular synthetic floor tile comprising at least one acute angle, which significance is set forth in terms of the ability of such an opening to enhance a particular performance characteristic of the floor tile, namely its coefficient of friction or traction. By providing at least one acute angle, or at least one segment of structural members that form an acute angle, assuming an appropriate size, the opening will comprise a wedge or wedge-like configuration that may receive a suitably pliable object therein as the object moves about the contact surface. Indeed, the opening may be configured to receive the object as the object is subject to a load or force causing the object to press against the contact surface. Furthermore, any lateral movement of the object about the contact surface, while still subject to the downward pressing load or force, will cause the portion of the object within the opening to press against the sides of the opening, or rather the structural members defining the opening. If the lateral movement is such so as to cause the portion of the object within the opening to press into the wedge formed by the acute angle, various compression forces will be induced that act on the object.

More specifically, each of the openings are configured to receive and at least partially wedge a portion of an object acting on the contact surface to enhance the coefficient of friction of the floor tile, and to provide increased traction about the contact surface. Indeed, the floor tile is configured with an enhanced coefficient of friction, which is at least partially a result of the size and geometry of the openings in the contact surface. For example, an object, such as a shoe being worn by an individual participating in one or more sports or activities, acting on or moving about the contact surface may be received within the openings, including the acute or wedged segment of the openings. In other words, at least a portion of the object may be caused to extend over the edges of the structural members of the contact surface and into the openings in the floor tile. This is particularly the case if the object is at least somewhat pliable.

As the object is caused to further move laterally across the contact surface in a direction toward the acute angle (such as in the case of an individual initiating movement in a certain direction), the object will be further forced into the acute segment or wedge of the opening comprising the acute angle. As this occurs, one or more compression forces are created by the various structural members on the portion of the object extending below the contact surface and into the openings, which compression force increases as the object is further wedged into the acute segment of the opening. As the object is wedged into the opening, and as the compression force on the portion of the object within the opening increases, the coefficient of friction is observably increased, which results in increased traction about the contact surface.

In operation, the compression force functions to increase the force necessary to remove the object from the opening. Stated differently, in order to progress in its movement about the contact surface, the object must be removed or drawn from the opening(s). In order to be removed or drawn from the opening(s), any compression forces acting on the wedged portion of the object, as applied by the structural members defining the opening(s), must be overcome. This increase in force required to draw the object from the openings and to move the object about the contact surface enables the floor tile and the resulting flooring system to exhibit enhanced performance characteristics as the traction about the contact surface is increased.

It is noted that the compression forces that act on the object to increase traction are small enough so as to not significantly increase the drag on the object, which might otherwise result in a reduction of efficiency of the object as it moves or is caused to be moved about the contact surface. In other words, an object moving about the contact surface will not encounter any noticeable drag nor any reduction in efficiency. Quite the contrary, it is believed that the increase in coefficient of friction or traction produced by the acute segments in the openings of the floor tile will instead function to, at least partially if not significantly, increase the efficiency of the object's movements by reducing the amount of slide or slip about the contact surface. This perceived increase in efficiency far outweighs any negative effect that an object might experience as a result of a slight increase in drag.

Figure 16:
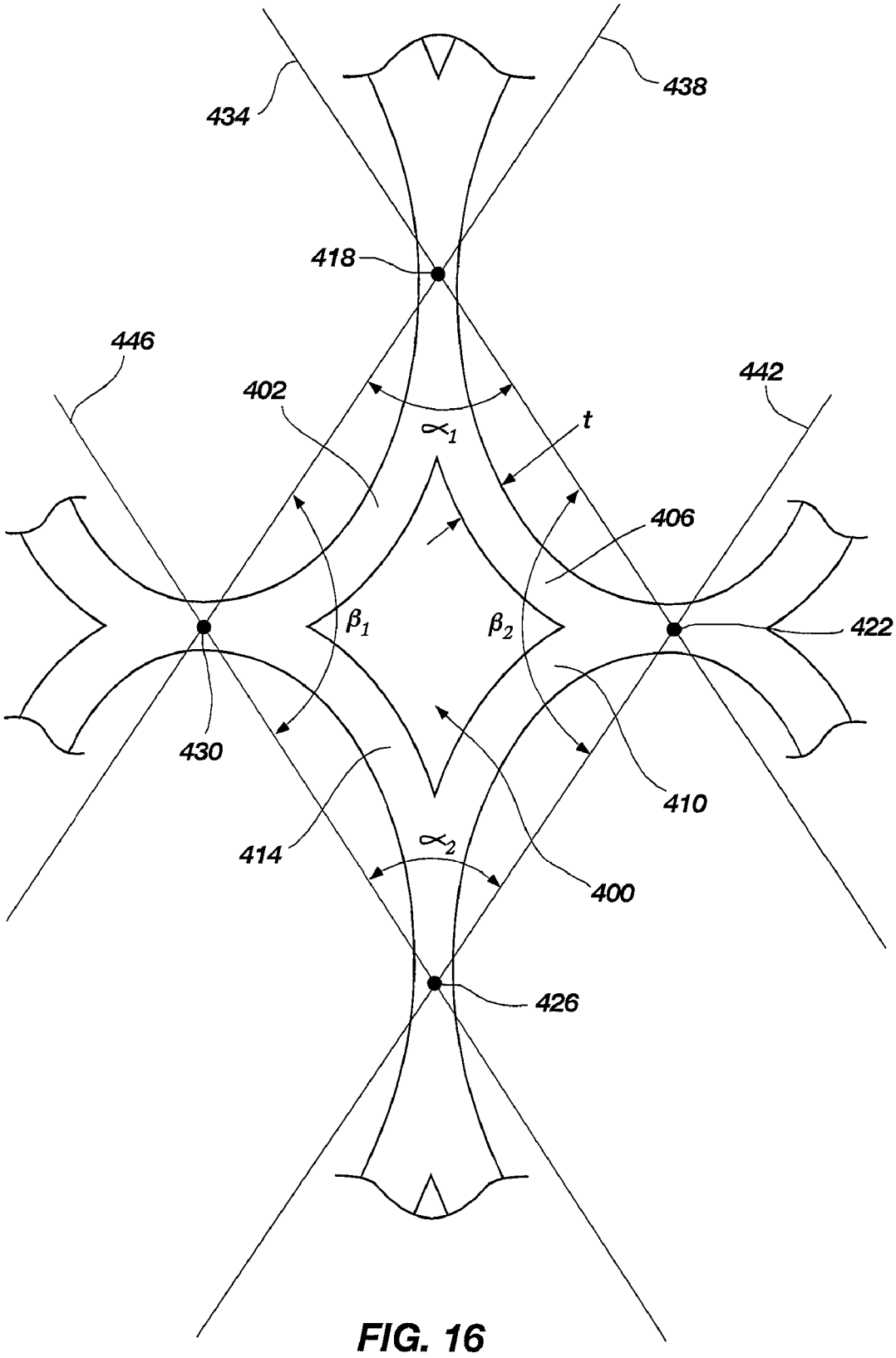
FIG. 16 illustrates a partial top view of an exemplary floor tile having a diamond-like opening.
Figure 23:
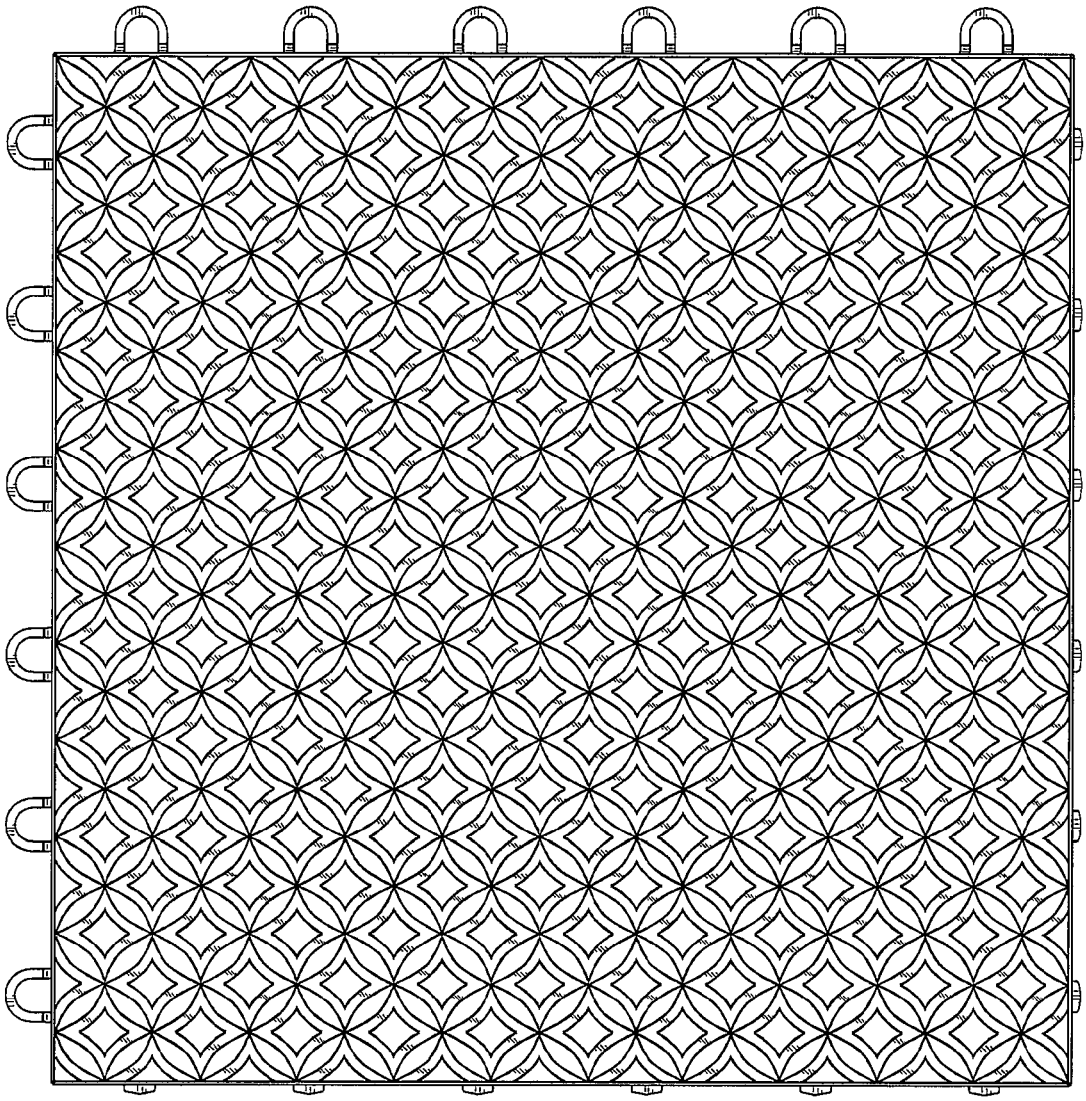
FIG. 23 illustrates a top view of a modular synthetic floor tile in accordance with still another exemplary embodiment of the present invention.

To provide at least one acute angle, the opening will consist of one or more shapes or geometries having an acute angle. Some of the geometries contemplated comprise a diamond shaped opening, a diamond-like shaped opening, and a triangular opening. Each of these are made up primarily of linear segments or sides. However, openings comprising various nonlinear or curved segments or sides are also contemplated, some of which are illustrated in FIGS. 16 and 23.

In order to be able to receive a portion of the object therein, the openings must be appropriately sized. Indeed, openings too small will have the effect of reducing the amount of the object that may be received into the opening, as well as the extent to which the object extends into the opening. As such, and as discussed above, the size of the opening for a given floor tile may be optimized.

The size of an opening may be measured in one of several ways. For instance, each of the openings will comprise a perimeter defined by the various structural members making up the perimeter. A measurement of this perimeter, taken along all sides, will provide a general size of the opening. It is contemplated that an optimal sized opening, measured in this way, will comprise a perimeter measurement between 1.5 and 3 inches.

Another way the openings may be determined is by measuring their length and width, as taken from the two furthest points of the opening existing along x-axis and y-axis coordinates. It is contemplated that an optimal sized opening, measured in this way, will comprise a length 0.25 and 0.75 inches and a width between 0.25 and 0.75 inches.

Still another measurement of the size of an opening may be in terms of its area, or rather its opening area as defined herein. Indeed, the openings may comprise an area between 50 $mm^2$ and 625 $mm^2$.

The size of the openings is directly related to the ratio of surface area to opening area. Indeed, the size of the openings may dictate the surface area provided by the top surfaces of the structural members, and thus the contact surface. Conversely, the surface area of the top surfaces of the structural members, and thus the contact surface, may dictate the size of the openings. As can be seen, these two are inversely related. An increase in one will decrease the other. As such, the ratio of these two design parameters is significant as the manipulation of this ratio provides another way to modify and enhance the coefficient of friction of the floor tile.

Figure 15:
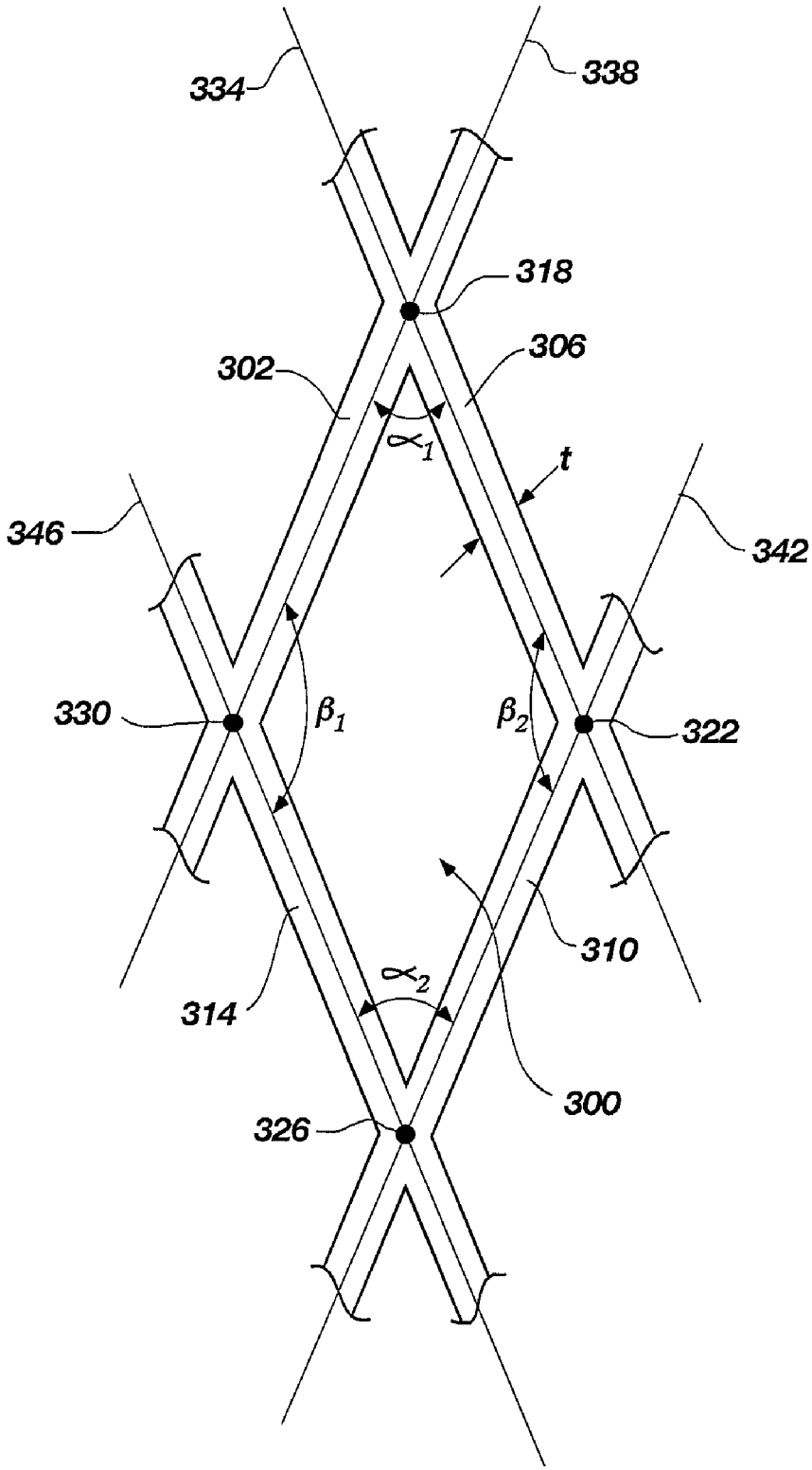
FIG. 15 illustrates a partial top view of an exemplary floor tile having a diamond shaped opening.

With reference to FIG. 15, illustrated is a detailed top view of an opening in a contact surface of a floor tile in accordance with another exemplary embodiment of the present invention. This opening 300 is similar to the opening 200 discussed above and shown in FIG. 14, except that its acute and obtuse angles are different. More specifically, the opposing acute angles are sharper, meaning the structural members defining the acute angles are formed on less of an angle. In addition, the opposing obtuse angles are less sharp, meaning the structural members defining the obtuse angles are formed on a greater angle. As shown, the opening 300 is defined by a plurality of linear structural members, having a thickness t, shown as structural members 302, 306, 310, and 314. The structural members are configured to intersect one another at a plurality of intersection points to define the size and geometry of the opening 300. Specifically, structural members 302 and 306 are configured to intersect one another at intersection point 318; structural members 306 and 310 are configured to intersect one another at intersection point 322; structural members 310 and 314 are configured to intersect one another at intersection point 326; structural members 314 and 302 are configured to intersect one another at intersection point 330.

Furthermore, structural member 302 is configured to intersect structural member 306 to form an acute angle $\alpha_1$ as measured between an imaginary longitudinal axis 334 of structural member 306 and an imaginary longitudinal axis 338 of structural number 302; structural member 310 is configured to intersect structural member 314 to form an acute angle $\alpha_2$ as measured between an imaginary longitudinal axis 342 of structural member 310 and an imaginary longitudinal axis 346 structural members 314; structural member 302 is configured to intersect structural member 314 to form an obtuse angle $\beta_1$ as measured between an imaginary longitudinal axis 338 of structural number 302 and an imaginary longitudinal axis 346 of structural member 314; structural member 306 is configured to intersect structural member 310 to form an obtuse angle $\beta_2$ as measured between an imaginary longitudinal axis 334 of structural member 306 and an imaginary longitudinal axis 342 of structural member 310. In accordance with this configuration, opening 300 is formed and defined to comprise two opposing acute angles and two opposing obtuse angles, thus forming a diamond shaped geometry.

As seen, this diamond shaped opening is more elongated than the diamond shaped opening of FIG. 14. Indeed, in the embodiment shown in FIG. 15, the acute angles $\alpha_1$ and $\alpha_2$ are each 45 degrees, and the obtuse angles $\beta_1$ and $\beta_2$ are each 135 degrees. As such, it will take a greater amount of force to wedge an object acting on or moving about the contact surface of a floor tile comprising openings configured this way the same distance into the opening, which will subsequently result in higher compression forces on the object if indeed wedged to such a distance. Higher compression forces will result in greater coefficient of friction about the contact surface. However, the object will be required to exert greater forces about the opening to achieve the same degree of wedging within the opening. This may or may not be desirable, but illustrates the affect on coefficient of friction different shaped openings may have.

With reference to FIG. 16, illustrated is a detailed top view of an opening in a contact surface of a floor tile in accordance with another exemplary embodiment of the present invention. The opening 400 is similar to the openings 200 and 300 discussed above and shown in FIGS. 14 and 15, except that its structural members comprise curved or nonlinear segments that intersect one another. As shown, the opening 400 is defined by a plurality of curved structural members, having a thickness t, shown as structural members 402, 406, 410, and 414. The structural members are configured to intersect one another at a plurality of intersection points to define the size and geometry of the opening 400. The radius or curvature of the curved segments of the structural members also function to define the size and geometry of the opening 400 as these may be modified. Specifically, structural members 402 and 406 are configured to intersect one another at intersection point 418; structural members 406 and 410 are configured to intersect one another at intersection point 422; structural members 410 and 414 are configured to intersect one another at intersection point 426; structural members 414 and 402 are configured to intersect one another at intersection point 430.

Furthermore, structural member 402 is configured to intersect structural member 406 to form an acute angle $\alpha_1$ as measured between an imaginary axis 434 of structural member 406 and an imaginary axis 438 of structural number 402; structural member 410 is configured to intersect structural member 414 to form an acute angle $\alpha_2$ as measured between an imaginary axis 442 of structural member 410 and an imaginary axis 446 structural members 414; structural member 402 is configured to intersect structural member 414 to form an obtuse angle $\beta_1$ as measured between an imaginary axis 438 of structural number 402 and an imaginary axis 446 of structural member 414; structural member 406 is configured to intersect structural member 410 to form an obtuse angle $\beta_2$ as measured between an imaginary axis 434 of structural member 406 and an imaginary axis 442 of structural member 410. In accordance with this configuration, opening 400 is formed and defined to comprise two opposing acute angles and two opposing obtuse angles. However, due to the curved nature of the structural members forming or defining the opening, it can be said that the opening 400 comprises a diamond-like shaped geometry rather than a true diamond shape.

FIG. 16 further illustrates another recognized concept of the present invention. Unlike the linear wedges in the openings 200 and 300 above, as created by the various linear structural members, the opening 400 comprises a curved wedge, or curved acute angle. Thus, rather than providing a constant increase in compression force as the object is further wedged, as is the case with openings 200 and 300, the opening 400 functions to increase the rate of change of the increase of the compression force on the object as it moves further into the wedge formed by the acute angle. Indeed, as the acute angle progressively sharpens towards its apex, the force needed to advance the object into the wedge of the opening will necessarily continually increase. This continuing increase in force will result in continually greater compression forces being induced and acting on the object by the structural members of the opening.

In each of FIGS. 14-16, it is apparent that for any compression forces to be induced on the object by the opening, there must be sufficient forces acting on the object to first, be received in the opening, and second, to cause a portion of the object to wedge into the acute angle of the opening. Thus, it can be said that the coefficient of friction of the contact surface will change with the amount and direction of force exerted on the contact surface by the object. Although this is true for any floor tile, providing a plurality of openings having at least one acute angle can significantly increase or enhance the coefficient of friction of a floor tile formed in accordance with the present invention over a prior related floor tile, wherein the same object is caused to exert the same magnitude and direction of force.

Figure 17:
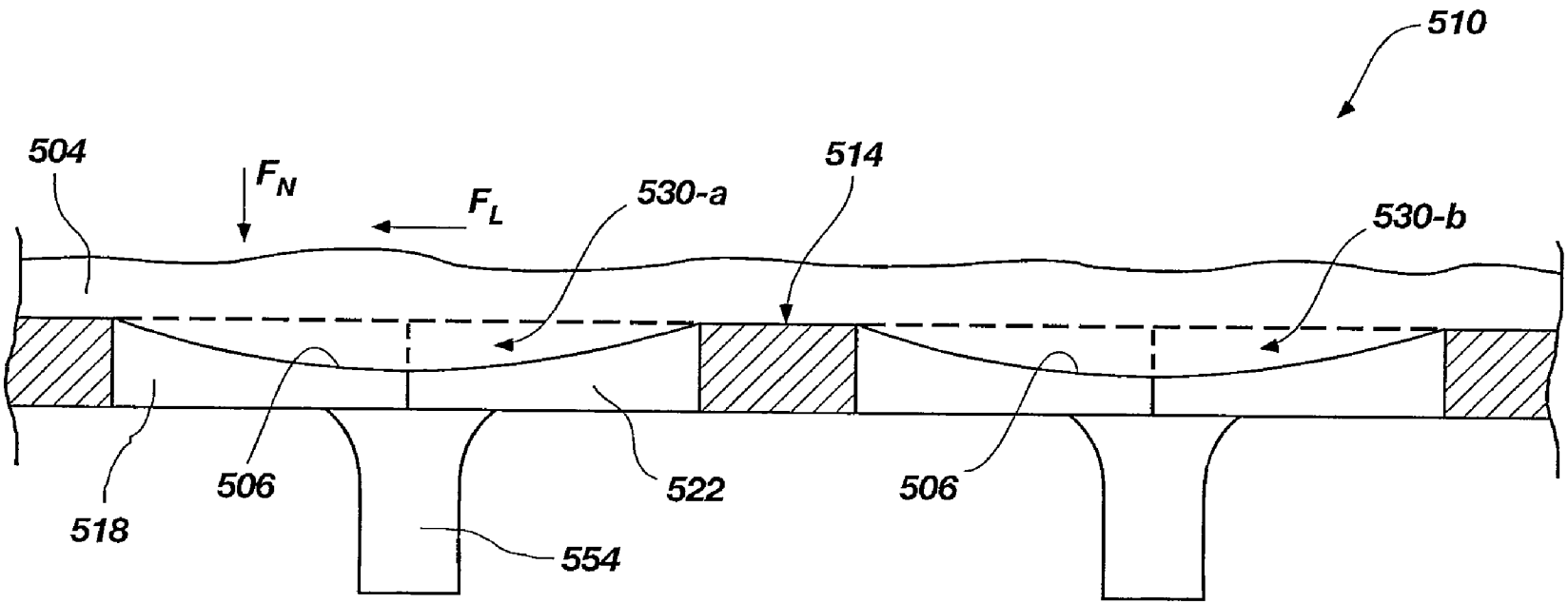
FIG. 17 illustrates a partial sectional side view of an exemplary floor tile and an object acting on a contact surface of the floor tile.
Figure 18:
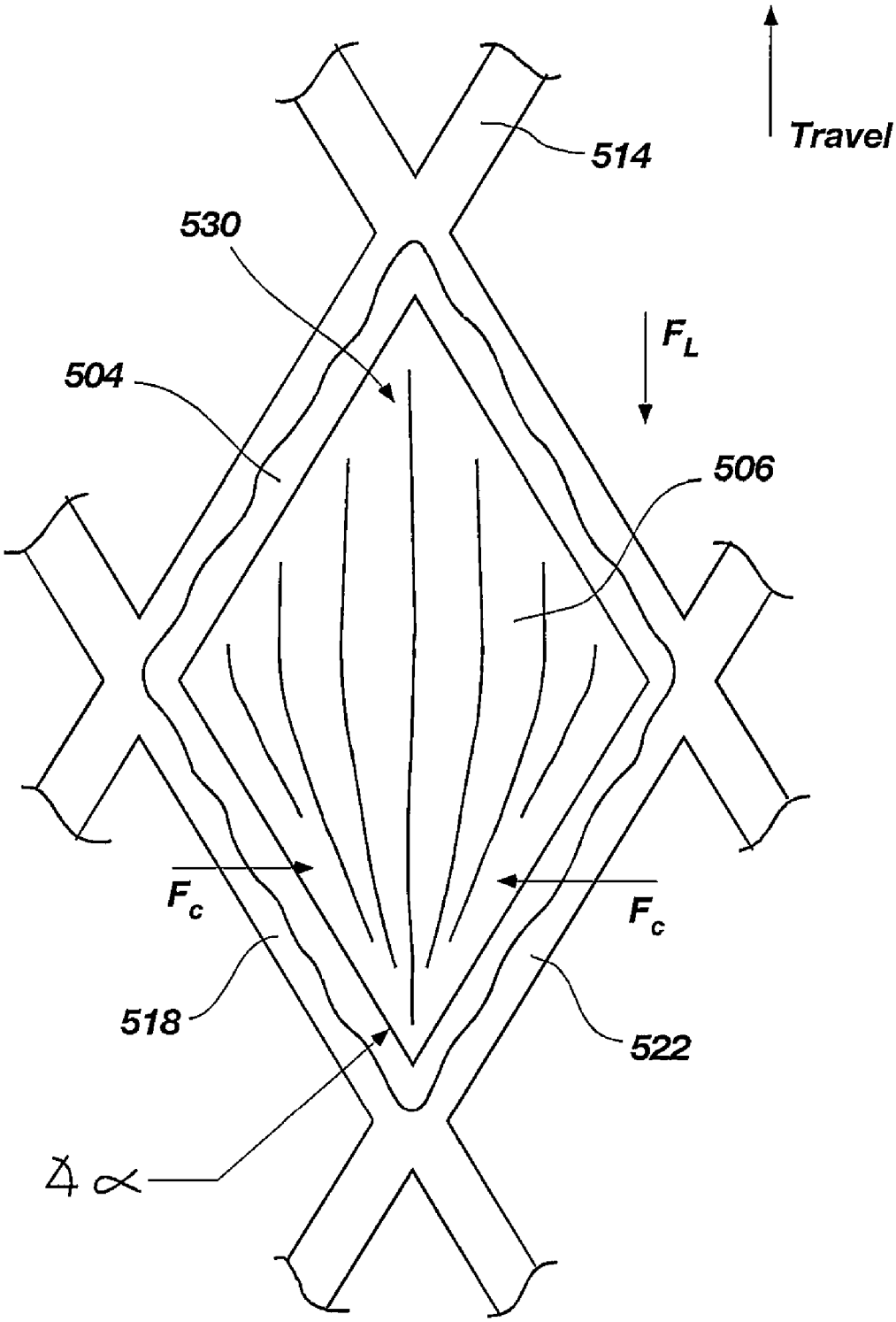
FIG. 18 illustrates a partial top view of the floor tile of FIG. 17.

FIGS. 17 and 18 illustrate an exemplary situation in which an individual is participating about a flooring system comprising a plurality of modular floor tiles formed in accordance with the present invention. Specifically, FIGS. 17 and 18 illustrate a portion of the sole 504 of a shoe (not shown) of an individual as acting on and moving about the contact surface 514 of a present invention floor tile 510 during a sporting event or other activity. The openings 530-*a* and 530-*b* comprise a diamond shaped geometry similar to the ones illustrated in FIGS. 1-13.

As one or more force normal $F_N$ act on the sole 504 of the shoe (assuming a suitable degree of pliability within the sole), such as that caused by the weight of the individual wearing the shoe and/or any movements initiated by the individual, a portion of the sole 504 is caused to be received into the openings 530-*a* and 530-*b* formed in the contact surface 514 of the floor tile 510, which portion of the sole 504 is identified as portion 506. The openings 530-*a* and 530-*b* are sized so as to permit this.

Furthermore, FIG. 18 illustrates the affect of any lateral forces $F_L$ acting on the sole 504 of the shoe. As shown, in the event one or more lateral forces $F_L$ is caused to act on the sole 504, and therefore the portion 506 of the sole 504 received in the opening 530, in the direction of one of the opposing acute angle $\alpha$ of the opening 530, this will cause the portion 506 of the sole 504 to wedge within the acute angle $\alpha$ defined by the various structural members 518 and 522. As this happens, one or more compression forces $F_C$ are induced by the structural members 518 and 522, which act on the portion 506 of the sole 504 of the shoe within the opening 530 to essentially squeeze the portion 506, as indicated by the several longitudinal lines of the sole 504 that converge upon one another within the acute angle of the opening 530. As discussed above, this effectively functions to increase the coefficient of friction about the contact surface 514. The degree of the acute angles and the thickness of the structural members (and thus the size of the openings) may all be manipulated to enhance the coefficient of friction of the floor tile.

EXAMPLE

Figure 19:
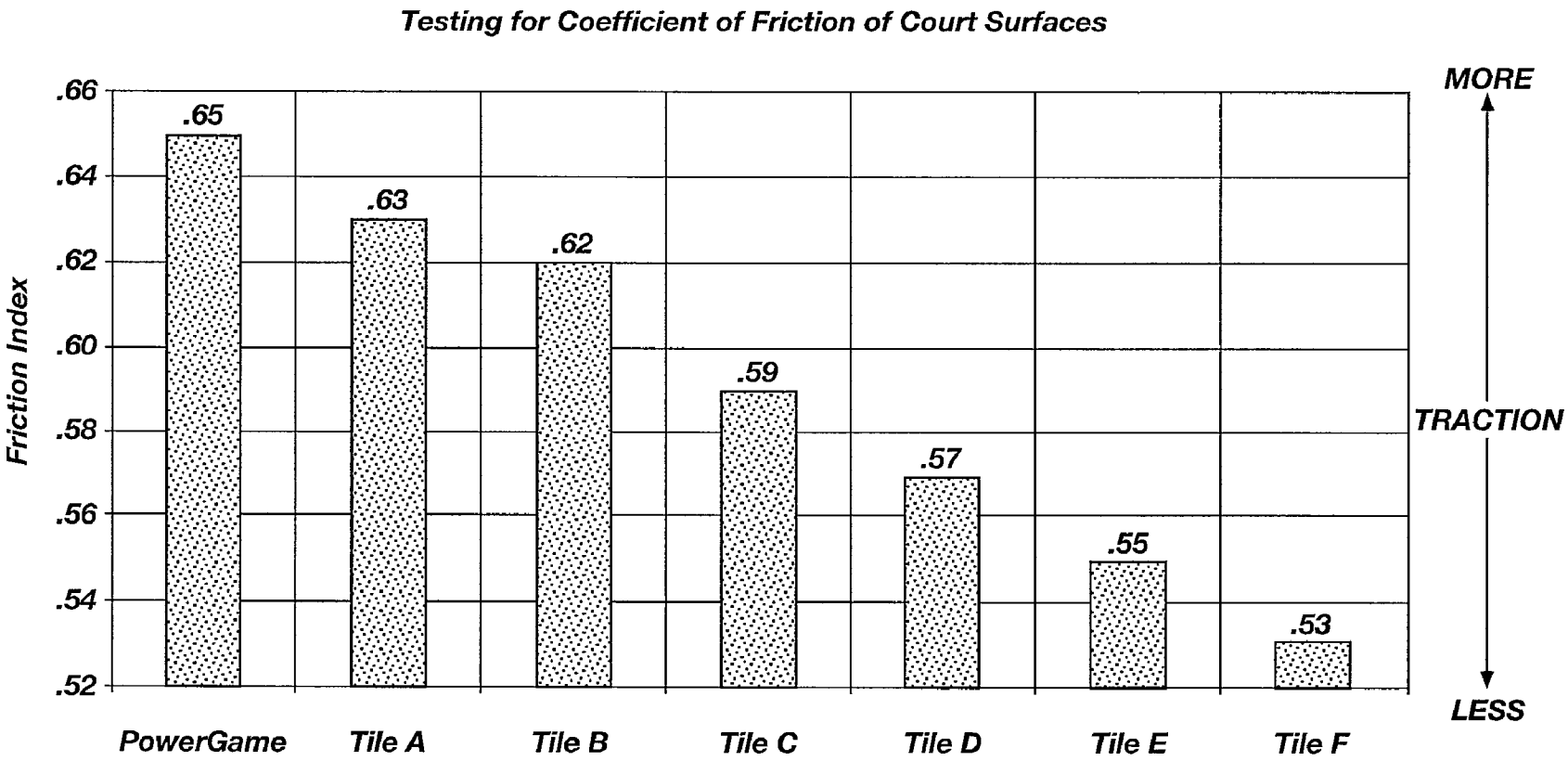
FIG. 19 illustrates a graph depicting the results of the coefficient of friction test performed on a plurality of floor tiles.
Figure 20:
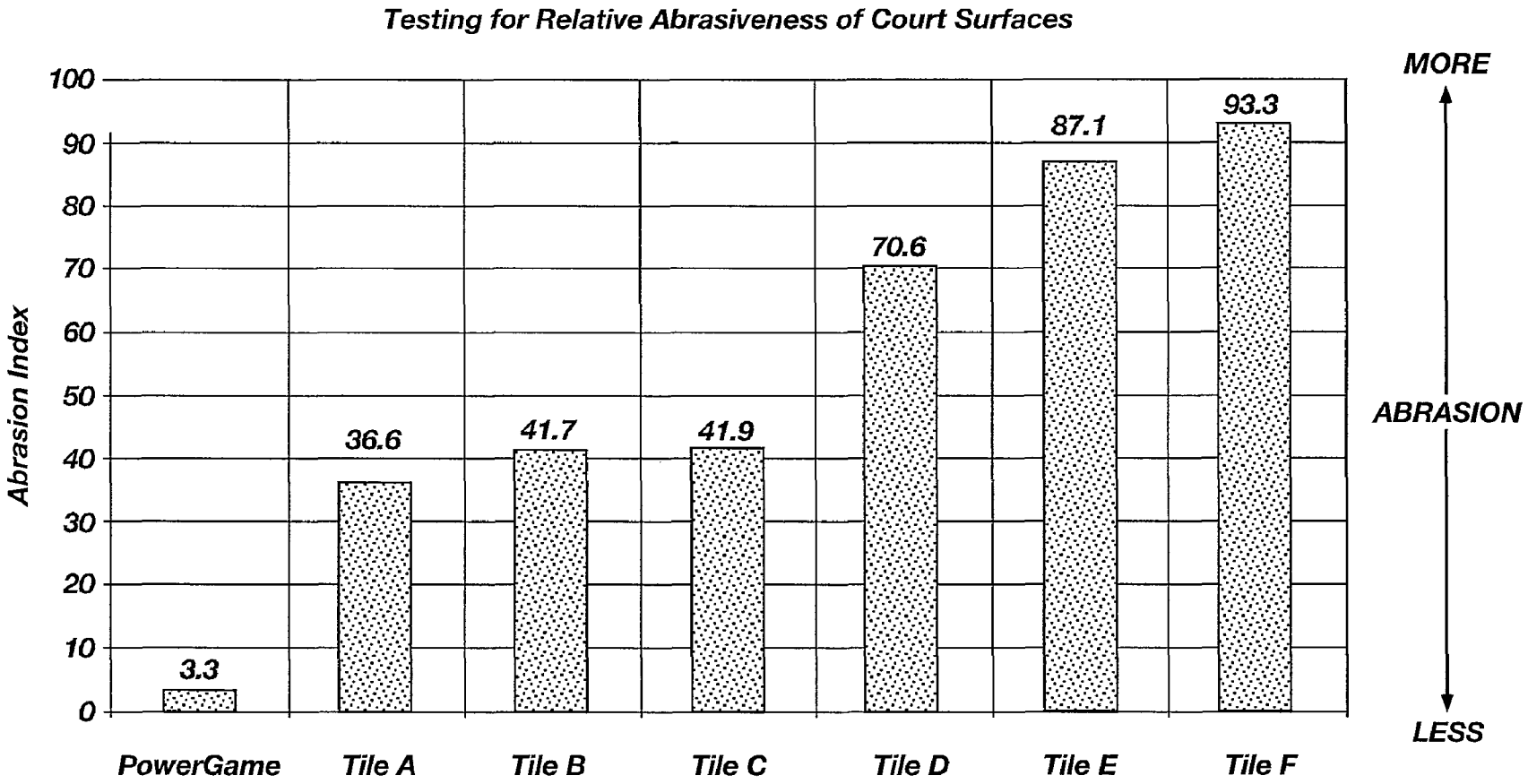
FIG. 20 illustrates a graph depicting the results of an abrasiveness test performed on a plurality of floor tiles.

FIGS. 19 and 20 illustrate the results of a coefficient of friction test and an abrasiveness test performed by an independent testing agency on the above-identified PowerGame floor tile from Connor Sport Court International, Inc. as it currently exits and as illustrated in FIGS. 8-13, as compared with the results from the same tests performed on several other popular floor tiles existing in the marketplace, shown as floor tiles A-F.

With reference to FIG. 19, and in accordance with ASTM C1028-06, the standard test method for determining the static coefficient of friction of ceramic tile and other like surfaces by the horizontal dynamometer pull-meter method, it can be seen that the PowerGame floor tile scored a higher coefficient of friction index than any of the other tested floor tiles A-F.

With reference to FIG. 20, and in accordance with ASTM F1015-03, the standard test method for relative abrasiveness of synthetic turf playing surfaces, it can be seen that the PowerGame floor tile scored a significantly lower abrasion index than any of the other tested floor tiles A-F. This is due to the several transition surfaces existing on the edges of the structural members and the perimeter of the PowerGame floor tile. In addition, this is a result of the lack of any nubs and/or texture on the contact surface of the PowerGame floor tile.

It is noted that the coefficient of friction of the PowerGame floor tile was higher than any other competing floor tile, while the abrasiveness of the PowerGame floor tile was the lowest. By optimizing the ratio of surface area to opening area, by optimizing opening geometry, by providing a smooth, planar contact surface, and by providing adequate transition surfaces, the coefficient of friction was maximized, while the abrasiveness was minimized.

Figure 21:
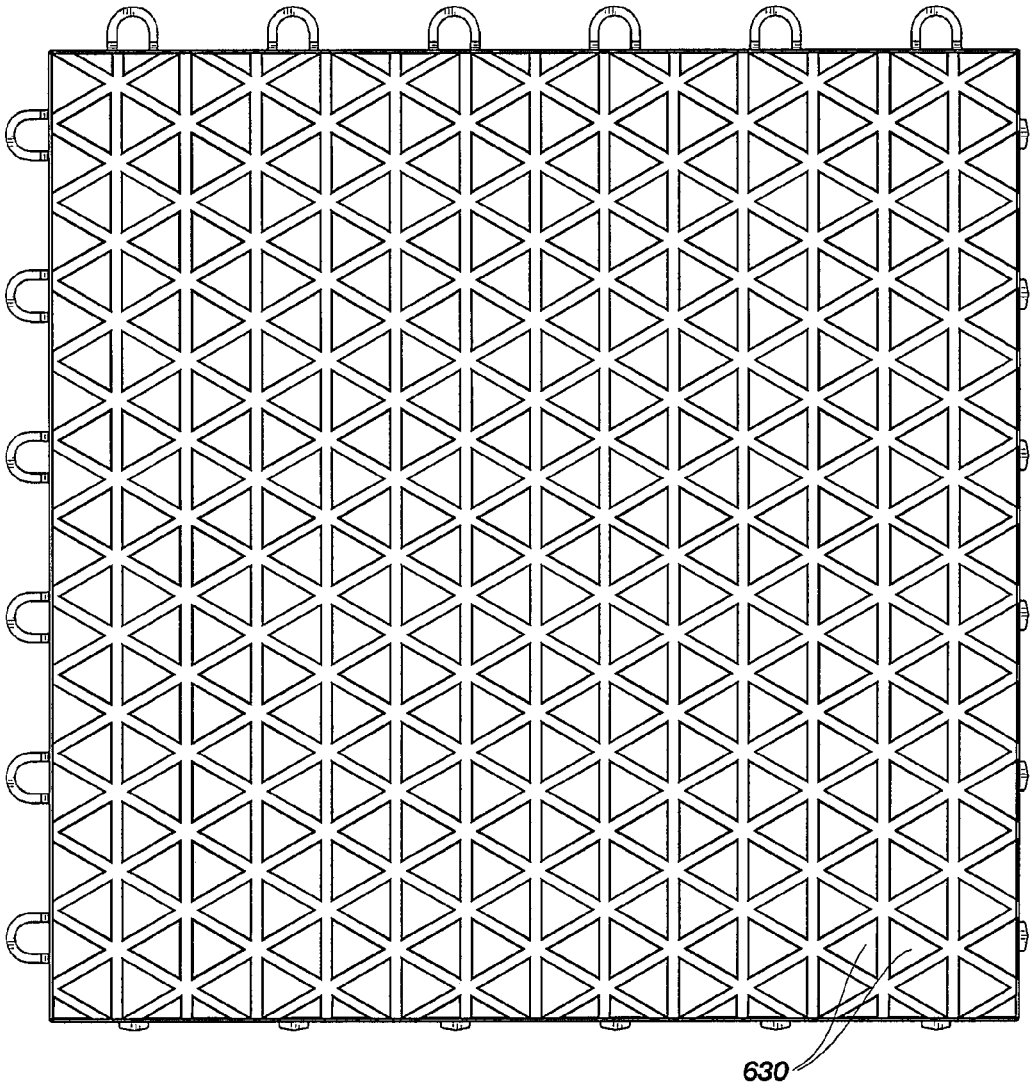
FIG. 21 illustrates a top view of a modular synthetic floor tile in accordance with still another exemplary embodiment of the present invention.
Figure 22:
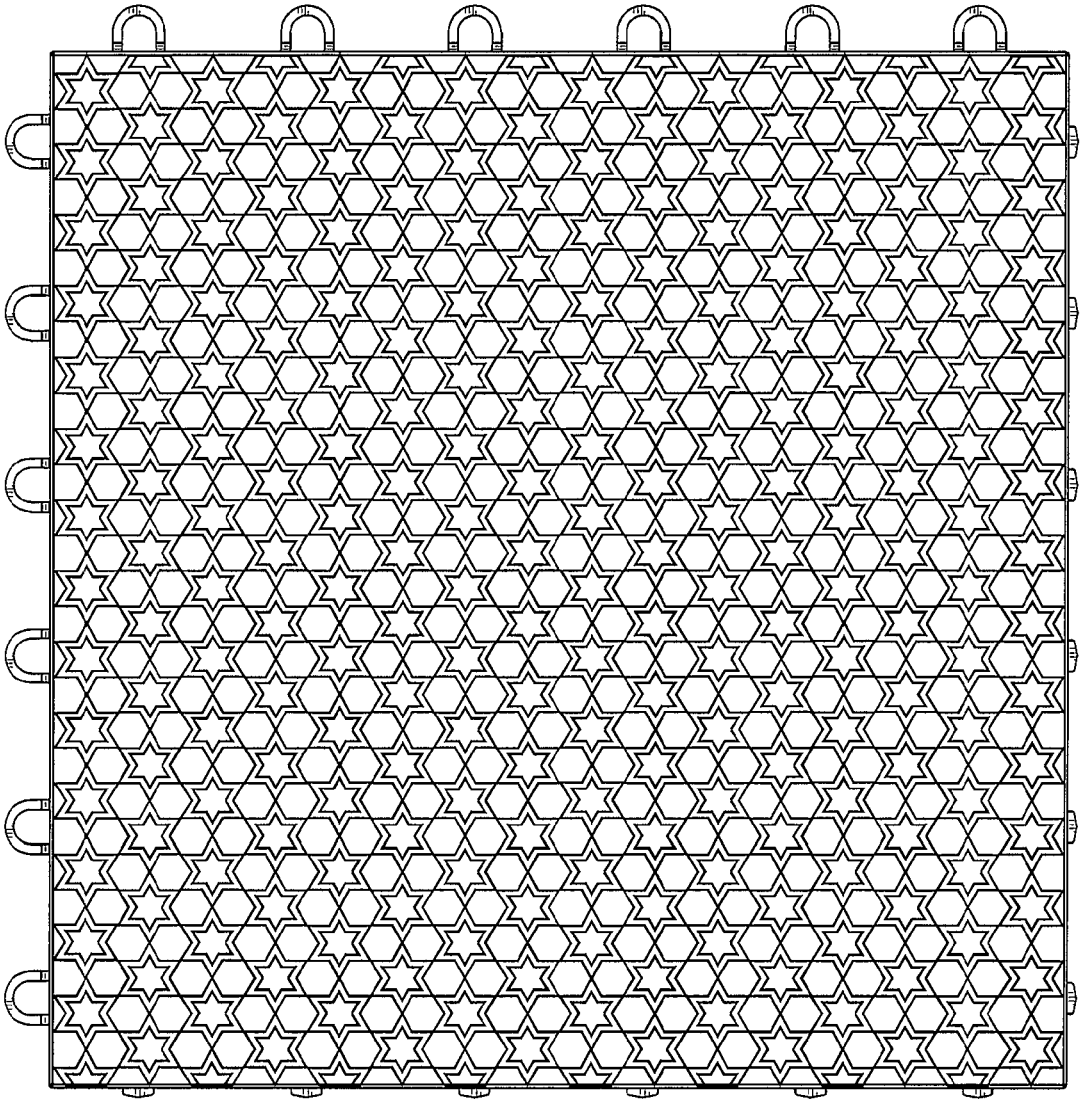
FIG. 22 illustrates a top view of a modular synthetic floor tile in accordance with still another exemplary embodiment of the present invention.
Figure 24:
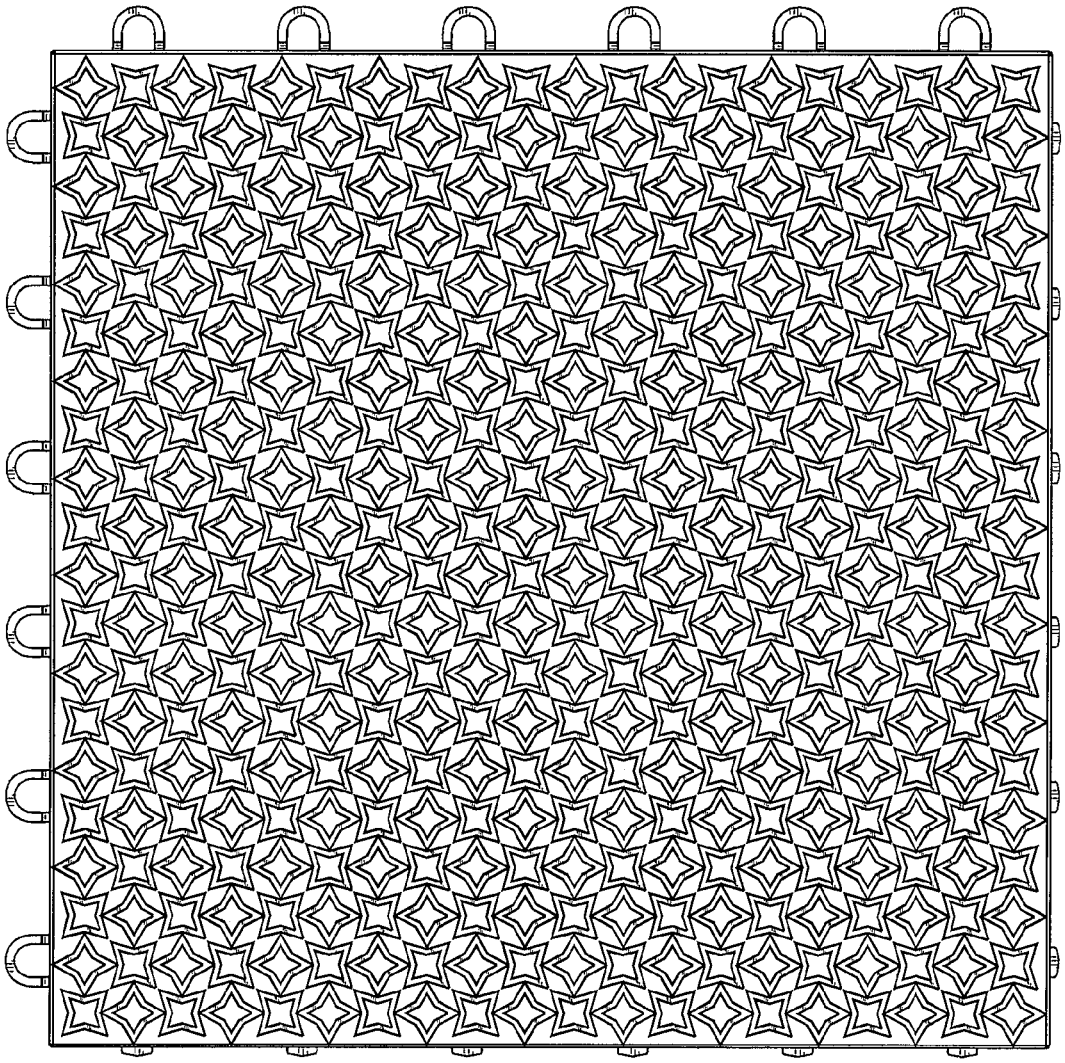
FIG. 24 illustrates a top view of a modular synthetic floor tile in accordance with still another exemplary embodiment of the present invention.

FIGS. 21-24 illustrate several different exemplary floor tile embodiments, each one comprising a plurality of openings having at least one acute angle. These figures are intended to illustrate that not all openings in a floor tile are required to comprise at least one acute angle, only some, in order to provide an enhancement of the coefficient of friction of a floor tile. FIG. 21 illustrates an exemplary floor tile 610 as comprising a plurality of openings 630 having a triangular shaped geometry. FIG. 22 illustrates an exemplary floor tile 710 as comprising a plurality of openings 730 having a star shaped geometry. A plurality of other openings 732 (hexagonal shaped) are also formed in the contact surface as a result of the recurring star openings. FIG. 23 illustrates an exemplary floor tile 810 as comprising a plurality of openings 830 having a square-like geometry with curved structural members forming acute angles. A plurality of other openings 832 (football shaped) are also formed in the contact surface as a result of the recurring square-like openings. FIG. 24 illustrates an exemplary floor tile 910 as comprising a plurality of openings 930 having a square-like shaped geometry, with each side comprising two inwardly slanted linear segments. A plurality of openings 932 are also formed in the contact surface as a result of the recurring square-like openings.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

More specifically, while illustrative exemplary embodiments of the invention have been described herein, the present invention is not limited to these embodiments, but includes any and all embodiments having modifications, omissions, combinations (e.g., of aspects across various embodiments), adaptations and/or alterations as would be appreciated by those in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited herein. Accordingly, the scope of the invention should be determined solely by the appended claims and their legal equivalents, rather than by the descriptions and examples given above.

What is claimed and desired to be secured by Letters Patent is:

1. A modular synthetic floor tile comprising:

an upper contact surface;

a plurality of openings formed in said upper contact surface, each of said openings having a geometry defined by structural members configured to intersect with one another at various intersection points to form at least one acute angle as measured between imaginary axes extending through said intersection points, said structural members having a smooth, planar top surface forming said contact surface, and a face oriented transverse to said top surface; and a transition surface extending between said top surface and said face of said structural members comprising a blunt edge between said top surface and said face.

2. The modular synthetic floor tile of claim 1, wherein said structural members are configured to form a wedge in said openings that is configured to receive and at least partially wedge a portion of an object acting on the contact surface, and to induce a compression force on said portion of said object, to further increase traction about said contact surface.

3. The modular synthetic floor tile of claim 1, wherein each of said openings comprise a geometry further defined by structural members configured to intersect with one another at various intersection points to form at least one obtuse angle as measured between imaginary axes extending through said intersection points.

4. The modular synthetic floor tile of claim 3, wherein said obtuse angle is configured to be between 95 and 175 degrees.

5. The modular synthetic floor tile of claim 1, wherein said acute angle is configured to be between 5 and 85 degrees.

6. The modular synthetic floor tile of claim 1, wherein each of said plurality of openings individually comprise a geometry selected from the group consisting of a diamond configuration, a diamond configuration having curved sides, a triangular configuration, a triangular configuration having curved sides, a rectangular configuration, and a rectangular configuration having curved sides.

7. The modular synthetic floor tile of claim 6, wherein said openings, in said diamond configuration and said diamond configuration having curved sides, comprise opposing acute angles and opposing obtuse angles as formed and defined by said structural members configured to intersect with one another at various intersection points, said opposing obtuse and acute angles being measured between imaginary axes extending through said intersection points.

8. The modular synthetic floor tile of claim 1, wherein each of said plurality of openings individually comprise a diamond shaped geometry.

9. The modular synthetic floor tile of claim 1, wherein said acute angle of said openings is defined by curved structural members, wherein said curved structural members function to increase the rate of change of an increase in compression forces acting on an object as it is being wedged into said acute angle.

10. The modular synthetic floor tile of claim 1, wherein said top surface of said structural members comprises a width between 0.03 and 0.1 inches, taken along a cross-section of said structural members.

11. The modular synthetic floor tile of claim 1, wherein said top surface of said structural members comprises a smooth, flat surface configuration.

12. The modular synthetic floor tile of claim 1, wherein said transition surface comprises a curved configuration having a radius of curvature between 0.01 and 0.03 inches.

13. The modular synthetic floor tile of claim 1, wherein said transition surface comprises a linear configuration oriented on an incline between 5 and 85 degrees, as measured from a horizontal axis.

14. The modular synthetic floor tile of claim 1, wherein said openings comprise a perimeter defined by said structural members, and wherein said openings are sized so that said perimeter, taken along all sides, measures between 1.5 and 3 inches.

15. The modular synthetic floor tile of claim 1, wherein said openings are sized such that their width, as measured from the two furthest points existing along an x-axis coordinate, measures between 0.25 and 0.75 inches.

16. The modular synthetic floor tile of claim 1, wherein said openings are sized such that their length, as measured from the two furthest points existing along a y-axis coordinate, measures between 0.25 and 0.75 inches.

17. The modular synthetic floor tile of claim 1, wherein said openings are sized to comprise an opening between 50 and 625 $mm^2$.

18. The modular synthetic floor tile of claim 1, further comprising a perimeter defining the various sides of said floor tile, said perimeter comprising a blunt edge.

19. A modular synthetic floor tile comprising:

a perimeter;

an upper contact surface contained, at least partially, within said perimeter;

a first series of structural members extending between said perimeter;

a second series of structural members extending between said perimeter, and intersecting said first series of structural members in a manner so as to form a plurality of openings in said upper contact surface, each of said openings having a configuration selected from a diamond geometry having at least one acute angle within the diamond geometry or a diamond geometry having curved sides defined by said intersection of said first and second series of structural members;

wherein said first and second series of structural members comprise a smooth, planar top surface, a face oriented transverse to said top surface, and a transition surface extending between said top surface and said face to provide said structural members with a blunt edge configured to reduce abrasiveness of said floor tile; and a device configured to couple said floor tile to at least one other floor tile.

20. The modular synthetic floor tile of claim 19, wherein said openings, having said diamond geometries or said diamond geometry having curved sides, comprise opposing acute angles and opposing obtuse angles as formed and defined by said structural members configured to intersect with one another at various intersection points, said opposing obtuse and acute angles being measured between imaginary axes extending through said intersection points.

21. The modular synthetic floor tile of claim 20, wherein said acute angles are configured to receive and at least partially wedge a portion of an object acting on said contact surface, and to induce a compression force on said portion of said object, to further increase traction about said contact surface.

22. A modular synthetic floor tile comprising:

an upper contact surface having a smooth, planar configuration; and a plurality of diamond shaped openings formed in said contact surface, each of said openings comprising at least two opposing acute angles, a perimeter, a face extending down from said perimeter and said upper contact surface, and a blunt edge extending between said face and said perimeter and about said perimeter.

23. A method for enhancing the performance characteristics of a modular synthetic floor tile, said method comprising:

providing a plurality of structural members to form an upper contact surface;

configuring said structural members to intersect one another at intersection points and to define a plurality of openings each having at least one acute angle as measured between imaginary axes extending through said intersection points, said openings configured to receive and wedge at least a portion of an object acting on said contact surface to provide increased traction about said contact surface, said structural members having a top surface forming said contact surface, and a face oriented transverse to said top surface; and configuring said structural members with a transition surface extending between said top surface and said face to provide each of the openings formed by said structural members with a blunt edge configured to reduce abrasiveness of said floor tile.

24. The method of claim 23, further comprising configuring said structural members to define a plurality of openings having a configuration selected from a diamond geometry with opposing acute angles and opposing obtuse angles as formed and defined by said structural members configured to intersect with one another at said intersection points, said opposing obtuse and acute angles being measured between imaginary axes extending through said intersection points.

25. The method of claim 23, further comprising causing said structural members to exert a compression force on at least a portion of an object as it is wedged into a portion of said opening formed on said acute angle.

26. The method of claim 23, further comprising sizing said openings such that their opening has an area between 50 and 625 $mm^2$.

27. The method of claim 23, wherein said top surface of said structural members comprises a width between 0.03 and 0.1 inches, taken along a cross-section of said structural members.

* * * * *